US007014341B2

(12) United States Patent
King et al.

(10) Patent No.: US 7,014,341 B2
(45) Date of Patent: Mar. 21, 2006

(54) DECORATIVE LUMINAIRES

(75) Inventors: Leslie Charles King, Loganville, GA (US); Carl T. Gould, Decatur, GA (US); Chester G. Vier, Conyers, GA (US)

(73) Assignee: Acuity Brands, Inc., Atlanta, GA (US)

( * ) Notice: Subject to any disclaimer, the term of this patent is extended or adjusted under 35 U.S.C. 154(b) by 286 days.

(21) Appl. No.: 10/679,167

(22) Filed: Oct. 2, 2003

(65) Prior Publication Data

US 2005/0073848 A1 Apr. 7, 2005

(51) Int. Cl.
*F21V 7/00* (2006.01)

(52) U.S. Cl. ..... 362/296; 362/304; 362/800; 362/346; 362/241; 362/247; 362/293

(58) Field of Classification Search ..... 362/296, 362/291, 297, 298, 305, 304, 299, 300, 800, 362/302, 346, 303, 228, 241, 247, 245, 260, 362/293, 364, 404, 516, 147, 555
See application file for complete search history.

(56) References Cited

U.S. PATENT DOCUMENTS 4,562,517 A * 12/1985 Pankin ..... 362/147
6,698,912 B1 * 3/2004 Yang ..... 362/516
6,860,628 B1 * 3/2005 Robertson et al. ..... 362/555

* cited by examiner

*Primary Examiner*—Stephen Husar
*Assistant Examiner*—Bertrand Zeade
(74) *Attorney, Agent, or Firm*—Kenneth E. Darnell

(57) ABSTRACT

Functional yet decorative luminaires intended to create distinctive environments within specific areas of a space in which one or more luminaires are used, the luminaires of the invention visually tie to architectural elements of the space by providing a customizable glow of color surrounding a typically white light that acts to illuminate the space functionally. A downlighting luminaire configured according to the invention as one example is typically configured to utilize two separate reflectors, usually reflectors having concave reflective surfaces and being mounted concentrically within a housing, an inner reflector directing light centrally through an aperture of the luminaire with the light so directed typically being white light useful for illumination intended to facilitate usual activities within the space. An outer reflector is spaced from the inner reflector with a transparent or translucent disc, such as an acrylic plastic disc, being held between the reflectors, the disc having a colored film adhered preferably to lower surfaces thereof to cause portions of the light emanating from lamping disposed above the disc to be colored by passage through the colored film, the disc being readily removable and replaced with a disc having a different color adhered thereto so that a particular luminaire can be customized as to color selection depending on user choice at any given time. An annulus of glowing, colored light exits the periphery of the luminaire aperture outwardly of the inner cone, the reflective surfaces of the outer reflector directing at least portions of the colored light passing through the disc and colored film through an annular aperture of the luminaire, thereby creating a distinctive appearance of a central, white shaft of light emanating from the inner reflector and a glowing annulus of colored light surrounding the white shaft of light. Peripheral edges of the inner reflector can be positioned flushly with the luminaire aperture or can extend to one or more positions outwardly of the luminaire aperture and thus "proud" of a ceiling or the like within which the luminaire is recessed, surface-mounted or pendently mounted inter alia.

31 Claims, 17 Drawing Sheets

DECORATIVE LUMINAIRES

BACKGROUND OF THE INVENTION

1. Field of the Invention

The invention relates generally to luminaires such as downlighting and/or pendently-mounted luminaires and particularly to such luminaires having multiple reflectors arranged such that light reflected through a luminaire aperture by at least one of the reflectors is colored to produce a dramatic appearance.

2. Description of the Prior Art

The use of downlighting has expanded in recent years due in part to a flexibility of use of the wide variety of available downlighting luminaires as well as the ability to apply downlighting in a variety of environments requiring either general lighting, task lighting, accent lighting and the like including combinations thereof. The very nature of downlighting permits the luminaires employed to be relatively unobtrusive since downlighting luminaires are typically recessed in a ceiling or the like. However, downlighting luminaires can provide a decorative function in addition to particular lighting functions by virtue of a multitude of options involving design features of the luminaires themselves as well as characteristics of the illumination produced by downlighting luminaires of particular configurations. Downlighting luminaires of the variety characterized at least in part by decorative illuminated produced within an environmental space are known and often involve color imparted to illumination produced by lamping that generates white light but which is colored prior to exiting luminaire apertures by means of colored lenses, diffusers and the like. Such decorative downlighting luminaires are available in the marketplace and have typically been utilized to draw attention to specific areas within an environmental space or to create an environment of distinction within a space as well as to provide a visual tie to architectural elements. In such applications, decorative downlighting luminaires have previously been used to highlight specific areas within an environmental space such as a receptionist or guest services desk, the illumination produced by such decorative downlighting luminaires permitting a viewer to more easily determine a location within a relatively larger space where instructions such as directions and the like can be obtained as well as being able to recognize a feature display area such as in a retail environment, or a snack bar or the like in a lobby or bookstore, as examples. Decorative downlighting luminaires producing distinctive illumination such as colored illumination can advantageously be used to tie or complement a color pallet employed by an architect or interior designer and to create distinctive environments such as in upscale offices, gathering places, corporate lobbies and the like. Such decorative downlighting luminaires must necessarily provide distinctive capabilities when compared with standard downlighting luminaires since decorative downlighting capabilities are typically employed in environments wherein other downlighting luminaires are employed for general lighting, task lighting and the like. Decorative downlighting luminaires must also be functional and efficient and thus be capable of those usual characteristics associated with downlighting luminaires, for example, efficiency, ability to dim, production of usable light, advantageous spacing, etc. Decorative downlighting luminaires must also be easy to assembly, install and wire without the need for uncommon tools and designed such that handling of such luminaries during installation does not result in cuts, abrasions or other injury to installers. Still further, decorative downlighting luminaires must also be easily maintained by relatively inexperienced personnel such that relamping and repair is readily accomplished without the need for particular training. In maintenance situations, maintainable components such as lamping must be readily accessible.

Particular decorative downlighting luminaires presently available are configured to produce a decorative function by means of trim employed essentially at the luminaire aperture, such trim typically taking the form of glass or acrylic rings or plates of varying sizes and configurations, such rings and plates usually having integral color and being disposed in the luminaire aperture or suspended below the aperture. Certain available decorative downlighting luminaires include medallions or decorative shapes, typically transparent cones or spheres, suspended at the center of a glass or acrylic ring. Certain other prior decorative downlighting luminaires include non-glass decorative elements such as acrylic elements including metallized finishes such as brushed or natural aluminum, brass, stainless steel or perforated metal as examples. Lamping for prior decorative downlighting luminaires ranges broadly in kind from incandescent, fluorescent, HID, and the like.

The variety of decorative downlighting luminaires available in the marketplace has not fully addressed user needs especially as to desired abilities to draw attention to specific areas within a space in a dramatic manner and for tying of illumination to architectural elements of a space. While such prior decorative downlighting luminaires have employed rings of colored glass or acrylic materials as annuli about peripheries of circular luminaire apertures either within the luminaire apertures or suspended therebelow, the illumination produced by such luminaires have appearances such as are associated with light passing through a lens or diffuser. Such illumination so produced lacks a dramatic glow such as would be desired by a user within certain use environments including environments intended to be distinctive.

Similar comments can be made relative to luminaires of other description including pendently mounted luminaires whether mountable directly to a ceiling or by mounting from a track or the like. Such luminaires can also be configured according to the teachings of the invention to yield the dramatic appearance disclosed herein.

The decorative luminaires of the present invention address needs thus alluded to by providing distinctive illumination characterized by an interior shaft of light directed into a space, such shaft of light typically being white light intended to provide certain typical lighting functions, the shaft of light further being essentially surrounded by an annulus of colored light presenting an exceptionally pleasing "glow" without having the appearance of being filtered through a lens or diffuser such as is commonly disposed within a luminaire aperture. The illumination produced by the present luminaires can be readily customized to provide differing coloration of illumination with minimal modification of present decorative luminaires. The decorative luminaires of the invention provide in this respect and in other respects to be described hereinafter advances in the art not heretofore contemplated.

SUMMARY OF THE INVENTION

The invention provides in several embodiments decorative luminaires characterized in part by concentric reflectors and one or more sources of light, an inner reflector typically having a light source positioned in surmounting relation to an inner end thereof and through which inner reflector a portion of the light generated by the light source passes either directly or through reflection from reflective surfaces of said inner reflector outwardly of the luminaire into an environmental space that is to be illuminated. In preferred embodiments of the invention, that light source producing illumination passing through the inner reflector produces white light as is useful for general illumination and the like, light thus passing through the inner reflector being directed into an environmental space for the typical uses associated with downlighting and other illumination applications. An outer reflector preferably concentric with the inner reflector is spaced therefrom and is typically mounted within a downlighting luminaire housing, as an example, a planar annulus typically formed of glass or acrylic material being disposed between the inner and outer reflectors at a location spaced from an aperture of the luminaire and preferably near an anterior end of the inner reflector, the annulus being mounted by clips carried by the luminaire housing. The annulus is either integrally colored, coated with a transparent or translucent colored film or covered with a colored film placed on top surfaces of the annulus or adhered to surfaces thereof, preferably lower surfaces of said annulus. When integrally or permanently colored with a particular coloration, the annulus can be removed to customize the luminaire as by substitution of an annulus of one color with an annulus of a differing color as desired. Use of an adherent film, as another example, permits utilization of a single annulus, preferably a clear, colorless annulus with films of differing coloration being employed to impart color to light produced by either the same light source that produces light passing through the inner reflector or a separate light source positioned to pass light only through the outer reflector, light passing through the outer reflector and out of the luminaire aperture having a color dependent upon the characteristics of the integrally colored annulus or of a colored film carried by the annulus. A distinctly pleasing appearance is thus provided in a ceiling or the like by the present downlighting luminaires, the quality of illumination being that of a luminous, colored glow surrounding a shaft of white light. It is to be understood, however, that the present luminaires can be configured such that colored light emanates from an interior reflector with white light emanating from the outer reflector. Still further, both reflectors can pass light of differing colors other than white therethrough with said colors either being the same or different from each other.

In a particular embodiment of the invention, the inner reflector is configured with a cylindrical sleeve fitting over a cylindrical innermost portion of said inner reflector, the sleeve having annular corrugations formed on outer surfaces thereof. The corrugations function with an annular O-ring to position the inner reflector at differing locations within the luminaire, outermost edges of the inner reflector being positionable, for example, flushly within the aperture of the luminaire or extending from said luminaire aperture at varying distances to provide an additional decorative function.

Lamping utilized in the several embodiments of the invention preferably comprises compact fluorescent lamps with one or more lamps being used depending upon luminaire configuration and size. Typically, compact fluorescent lamps are disposed in a horizontal orientation within the present luminaires in part as an accommodation to minimize luminaire height. In downlighting applications in particular, a luminaire housing mounting compact fluorescent lamping in horizontal orientations is preferably provided with openings for receiving such lamping in a conventional manner. Spring-loaded hinges are provided in preferred embodiments for mounting one or more lamp doors to the luminaire housing to cover openings formed in the luminaire housing, the openings providing clearance for the lamping. It is to be understood that lamping can be oriented vertically within a luminaire housing configured according to the invention without departing from the scope of the invention. Still further, a source of illumination producing white light, for example, can be employed for producing light passing through the inner reflector, light intended essentially only for passage through the outer reflector being produced in certain embodiments of the invention by means of a separate light source or sources such as light emitting diodes or LEDs. Since light emitting diodes are capable of producing colored light, that light directly produced by the light emitting diodes can be passed through a diffusing annulus located interiorly of the luminaire housing between inner and outer reflectors Such an annulus can be coated or provided with a film of a material which is capable of altering the color of light produced by LEDs used as a light source within a luminaire configured according to such an embodiment of the invention. In all embodiments of the invention, the light directed by the present luminaires into an environmental space can be customized as to coloration with a minimum of modification of structural elements of the luminaries.

Accordingly, it is an object of the invention to provide decorative luminaires capable of producing illumination of different character from different portions of an aperture of one of said luminaires, a central beam of light emanating from said luminaire typically providing a controlled distribution for usual lighting functions such as general lighting, accent lighting or the like, a second portion of that light emanating from said luminaire being characterized by differing visible properties such as differing coloration from the first-mentioned light, the second portion of the light typically being of a diffuse nature, thereby to provide a luminaire that functions to produce contrasting illumination of decorative appearance.

It is another object of the invention to provide decorative downlighting luminaires in particular having at least one reflector capable of assuming differing positions within a luminaire housing such that in at least one position a lower edge of the reflector is positioned flushly with luminaire aperture and in other positions is recessed into the luminaire housing or extends outwardly of the luminaire aperture, the luminaire producing decorative illumination typically characterized by a central beam of white light surrounded by an annulus of colored light providing a distinctive colored glow about a central beam of white light.

It is yet another object of the invention to provide decorative luminaires and particularly downlighting luminaires customizable as to coloration of illumination produced thereby and particularly luminaires capable of directing beams of differing coloration from apertures thereof.

Further objects and advantages of the invention will become more readily apparent in light of the following detailed description of the preferred embodiments.

DETAILED DESCRIPTION OF THE PREFERRED EMBODIMENTS

Figure 1:
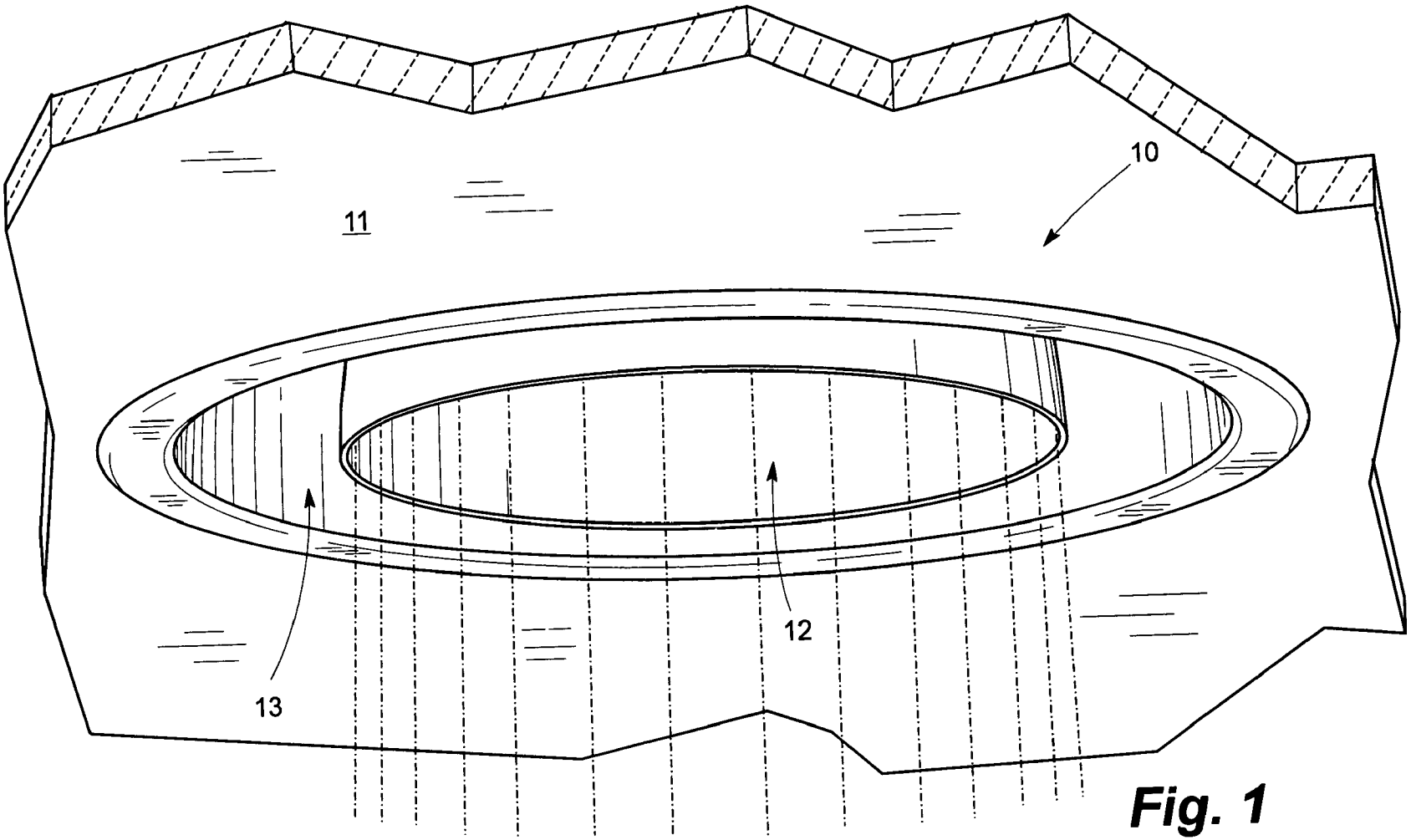
FIG. 1 is a perspective view of a decorative downlighting luminaire configured according to the invention and shown mounted in a ceiling in a typical use environment wherein only portions of the luminaire are visible from within the use environment.

Referring now to the drawings and particularly to FIG. 1, portions of a decorative downlight luminaire seen generally at 10 are mounted substantially flushly with a ceiling 11, the luminaire 10 directing an illuminating beam 12 from central portions thereof, the beam 12 preferably being white light intended to provide illuminating functions such as general lighting, task lighting, accent lighting and the like within an environmental space within which the luminaire 10 is mounted. As noted by the appearance of the illumination provided by the luminaire 10, the beam 12 is seen to be surrounded by an annulus of light generally seen at 13, the annulus 13 of light essentially surrounding the beam 12 as shown. The overall appearance and affect of the illumination provided by the luminaire 10 being that of a surreal glow reminiscent of impressionistic art and even art deco in its affect on observers thereof. The beam 12 of preferably white light appears in an actual installation of the luminaire 10 to be surrounded by the annulus 13, the light emanating from the annulus 13 preferably being of a desired coloration and/or of a characteristic differentiated from the light of the beam 12. In the installation as shown in FIG. 1, the central beam 12 appears to "float" within the colored annulus 13.

Figure 2:
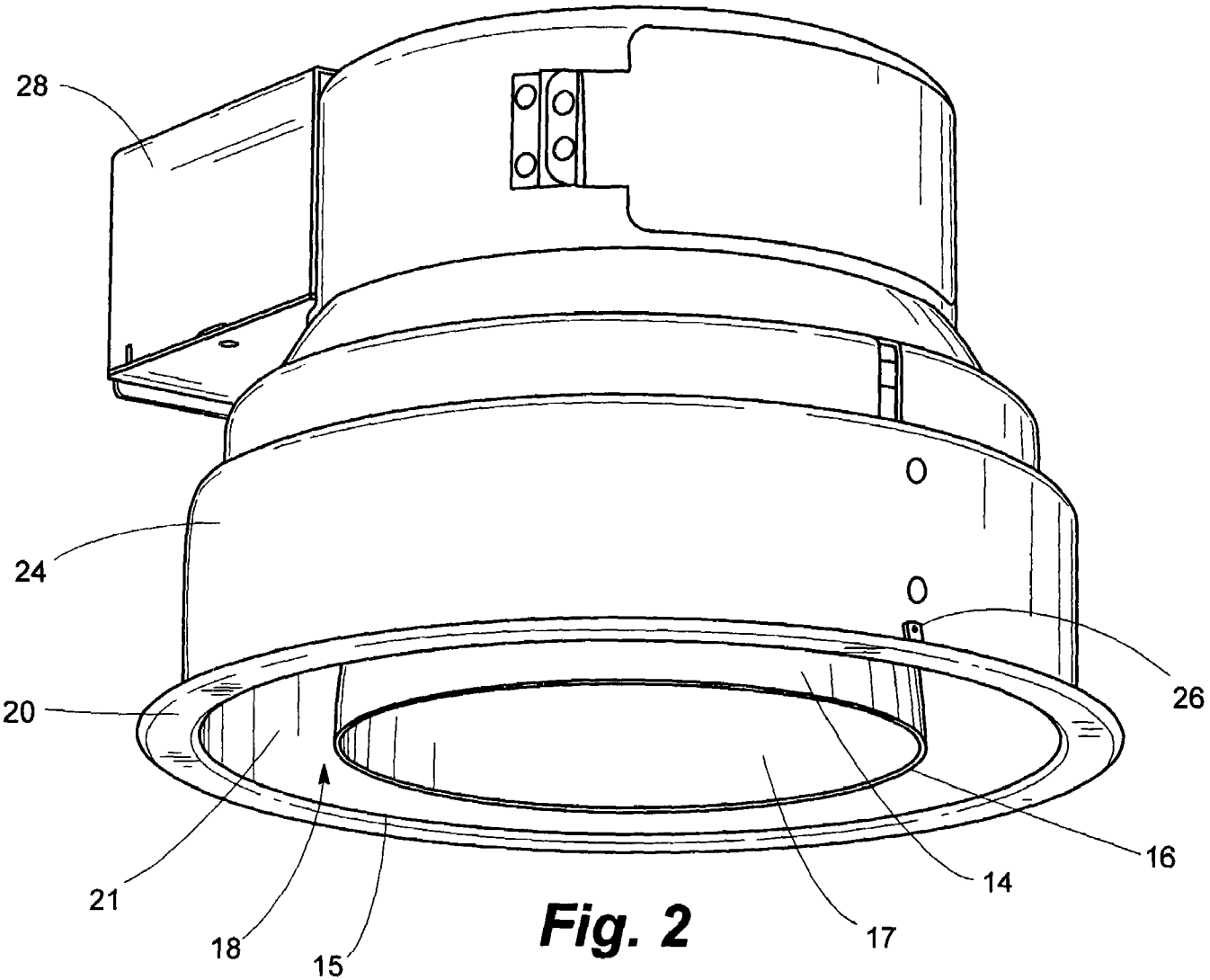
FIG. 2 is a perspective view of a first embodiment of the decorative downlighting luminaire of the invention.

Referring now to FIG. 2 additionally to FIG. 1, an inner reflector 14 is seen to be centrally disposed within aperture 15 of the luminaire 10, the inner reflector 14 having a lower peripheral annular edge 16. Reflective surfaces 17 of the inner reflector 14 are typically taken to be parabolic in contour although other suitable shapes can be employed. The reflective surfaces 17 are preferably formed from or coated with a highly specular material such as anodized aluminum or the like. The inner reflector 14 is primarily intended to efficiently direct as much light through the luminaire aperture 15 as possible in order to lend efficiencies of operation to the luminaire 10. Concentric with the inner reflector 14 is an outer reflector 18 only portions of which can be seen in FIGS. 1 and 2, the outer reflector 18 having an annular flange 20 disposed along a lower peripheral edge thereof, interior reflective surfaces 21 of the outer reflector 18 typically being formed of reflective white paint or the like. The outer reflector 18 functions primarily to reflect at least a portion of light emanating from lamping 22 (seen inter alia in FIG. 3) that does not pass through the inner reflector 14 or directly out of the luminaire aperture 15 between outer surfaces of the inner reflector 14 and the reflective surfaces 21 of the outer reflector 18. The outer reflector 18 is mounted to luminaire housing 24 by means of clips 26 as will be described in more detail hereinafter. The annular flange 20 of the outer reflector 18 functions primarily to provide a finished appearance about an opening (not shown) in the ceiling 11, which opening is normally essentially co-planar with the aperture 15 of the decorative downlighting luminaire 10. The housing 24 is further seen to be provided with an electrical compartment 28 such as is conventional in certain kinds of downlighting luminaires for housing electrical components and other conventional components such as lamp holders and the like for mounting of base portions of the lamping 22 inter alia. The luminaire 10 is intended to be mounted in a recessed fashion above a ceiling by mounting structure (not shown) of conventional structure, such mounting structure not being explicitly shown for ease of illustration.

Figure 3:
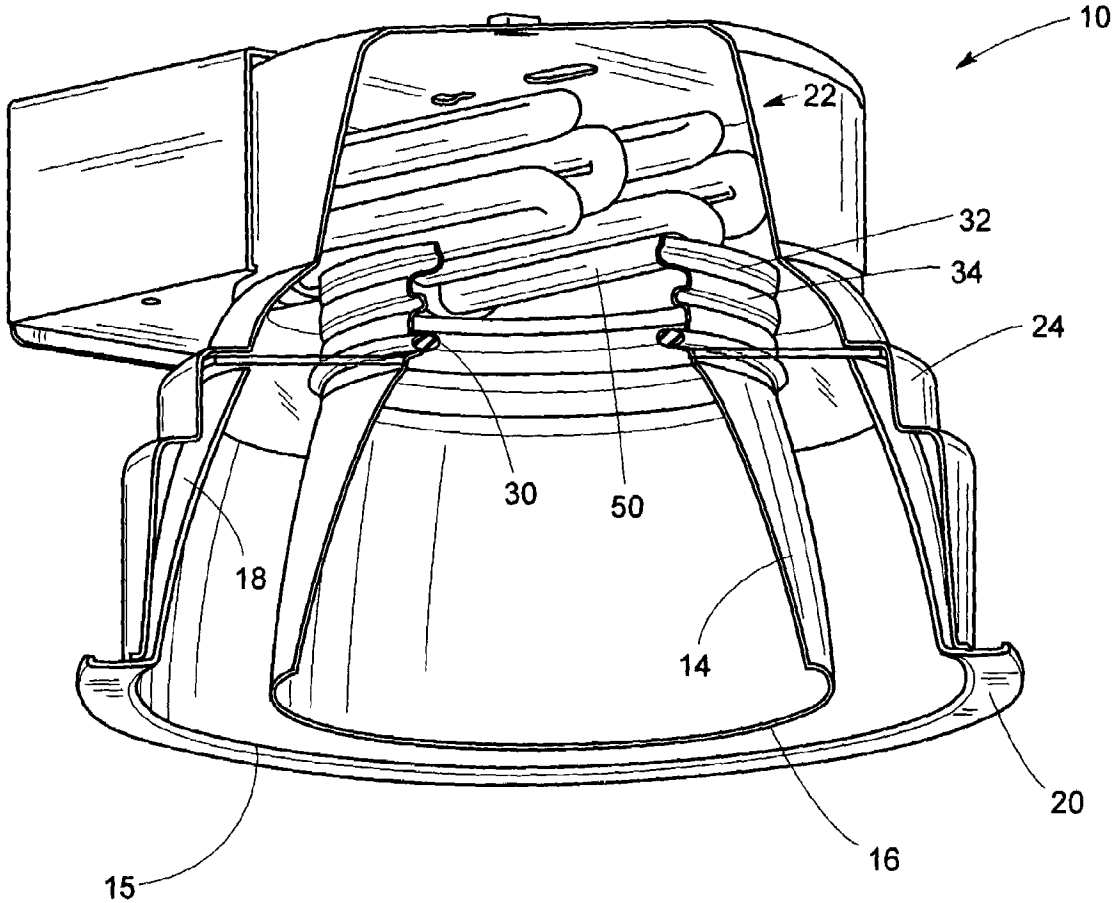
FIG. 3 is a perspective view partially cut away of the decorative downlighting luminaire of FIG. 2 shown with outermost edges of an inner reflector disposed in a plane of a luminaire aperture.
Figure 4:
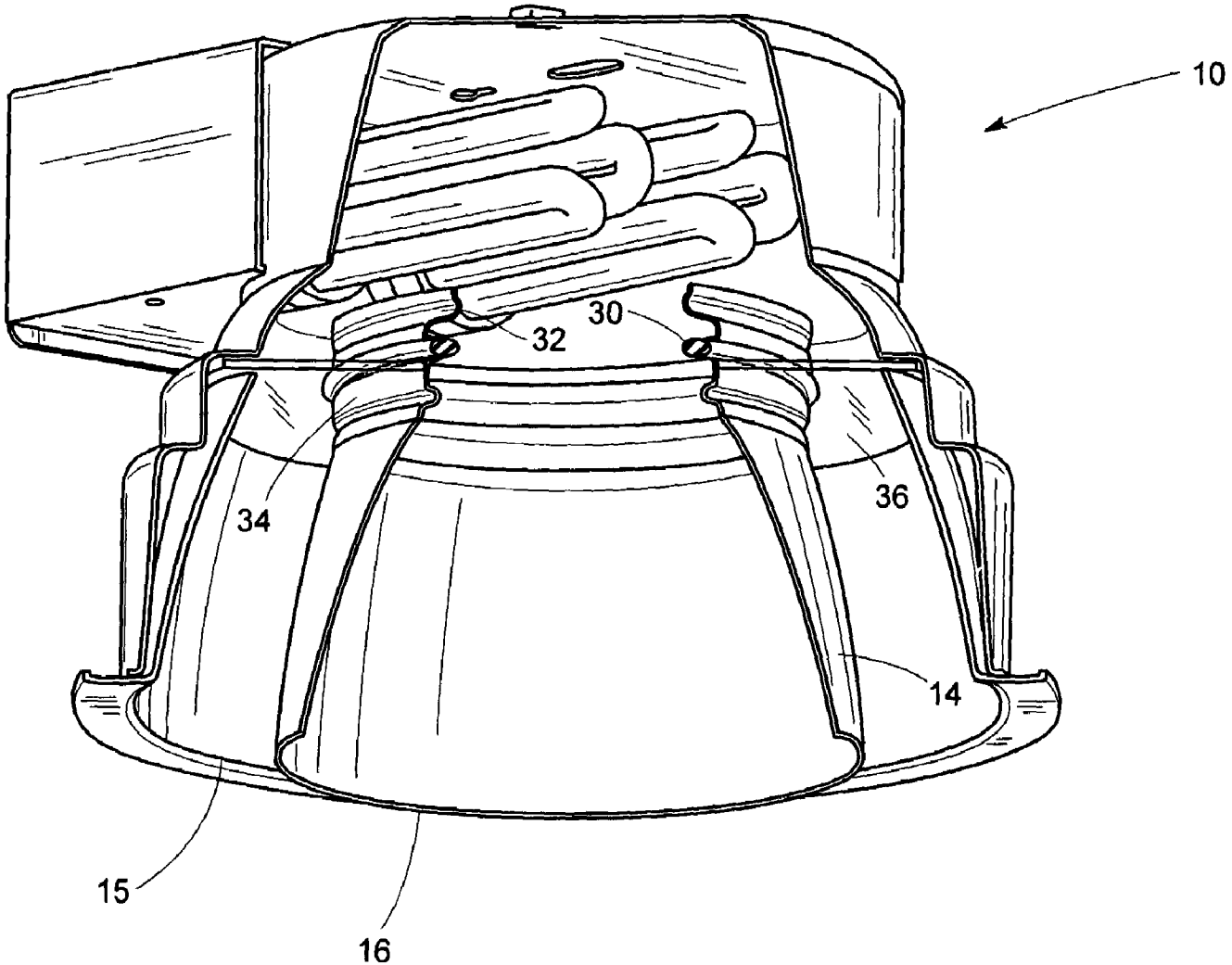
FIG. 4 is a perspective view partially cut away showing the luminaire of FIG. 3 with lowermost portions of the inner reflector shown extended a first distance outwardly into an environmental space through the aperture of the luminaire.
Figure 5:
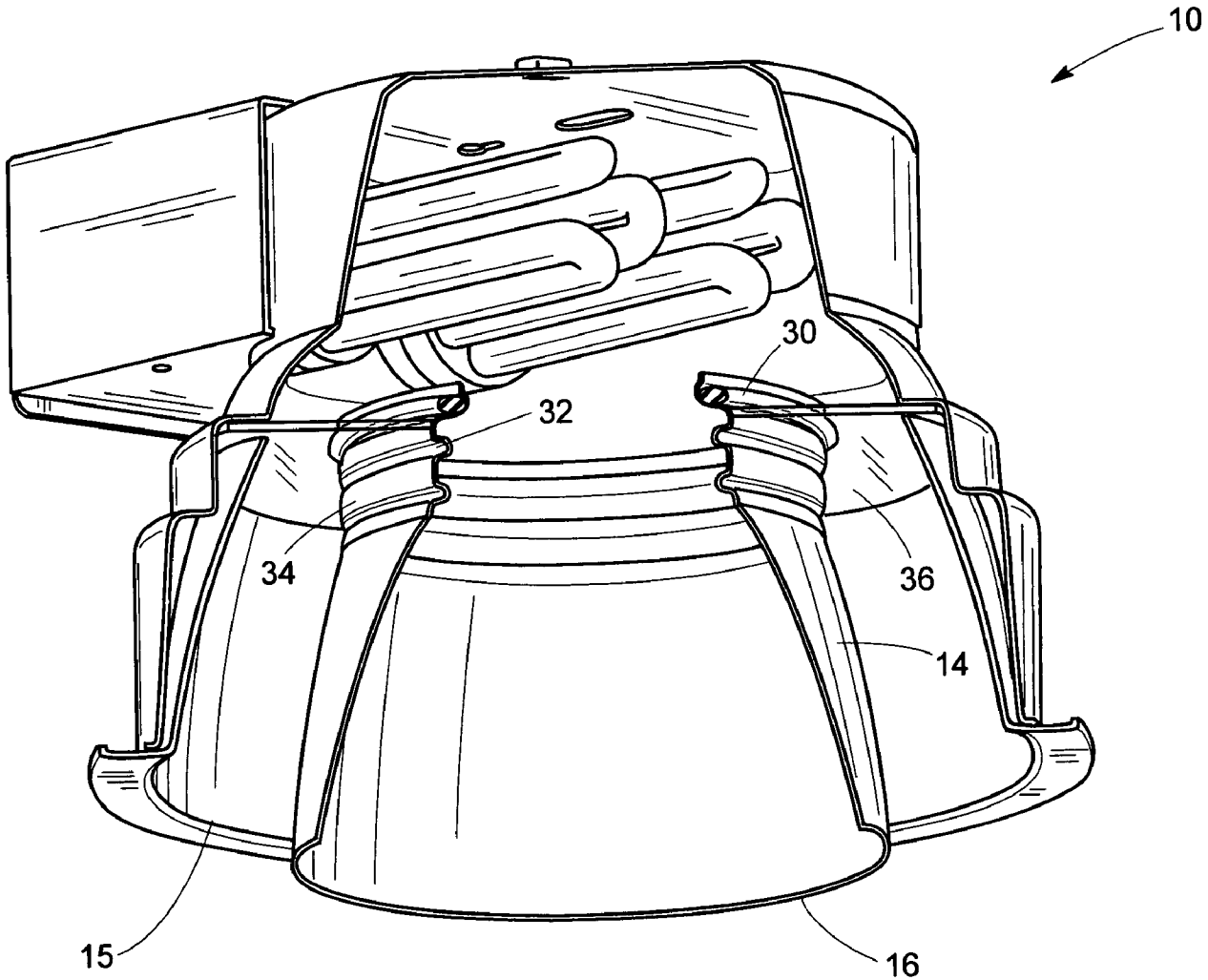
FIG. 5 is a perspective view partially cut away illustrating a further extension of the outermost edges of an inner reflector of said luminaire through the luminaire aperture.

The appearance of the decorative downlighting luminaire 10 can be caused to vary depending upon the position of the inner reflector 14 as can be seen in FIGS. 3 through 5. In FIG. 3, the lower edge 16 of the inner reflector 14 is disposed substantially flushly with lower edges of the outer reflector 18 and the annular flange 20 of the housing 24 and further with the plane of a ceiling (not shown in FIG. 3). The position of the inner reflector 14 as seen in FIG. 3 is that position providing the decorative affect of the luminaire 10 as seen in FIG. 1. Referring now to FIG. 4, the lower edge 16 of the inner reflector 14 is seen to be extended a certain distance below the aperture 15 of the luminaire 10, thereby to extend slightly into the environmental space being illuminated by the luminaire 10. As is seen in FIG. 5, the lower edge 16 of the inner reflector 14 is extended still further beyond the aperture 15 of the luminaire 10, thereby to extend still further below a ceiling (not shown in FIG. 5) and into the environmental space within which the luminaire 10 provides illumination. As can be seen in FIGS. 3 through 5 inter alia, the location of the inner reflector 14 in the relative positions therein illustrated is caused to occur through a positioning of an O-ring 30 preferably formed of an elastomeric material, the O-ring 30 being manually displaceable to different locations best referred to as annular indentations 32 disposed between a series of spaced annular corrugations 34. The O-ring 30 rests against an upper surface of an annulus element 36, essentially a planar ring, the annulus element 36 having a central opening 38 formed therein through which upper portions of the inner reflector 14 extend, said upper portions of the reflector 14 carrying a substantially cylindrical sleeve 40 having an outer surface on which the annular indentations 32 and the spaced annular corrugations 34 are formed. In altering the location of the inner reflector 14 within the luminaire 10, the resilient O-ring 30 is manually "rolled" over the cylindrical sleeve 40 and into that indentation 32 intended to locate the inner reflector 14 at a desired position as seen in FIGS. 3 through 5.

Figure 7:
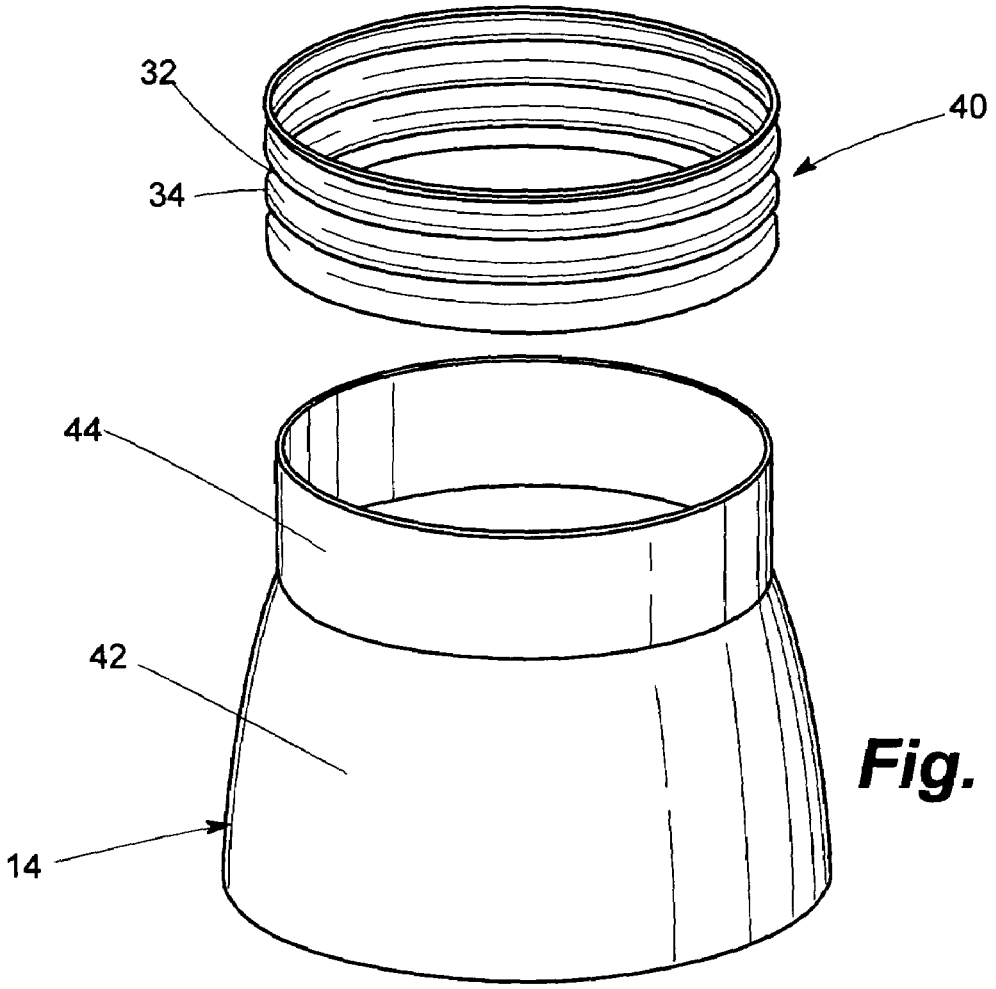
FIG. 7 is an exploded view of an inner reflector configured according to one embodiment of the invention.
Figure 8:
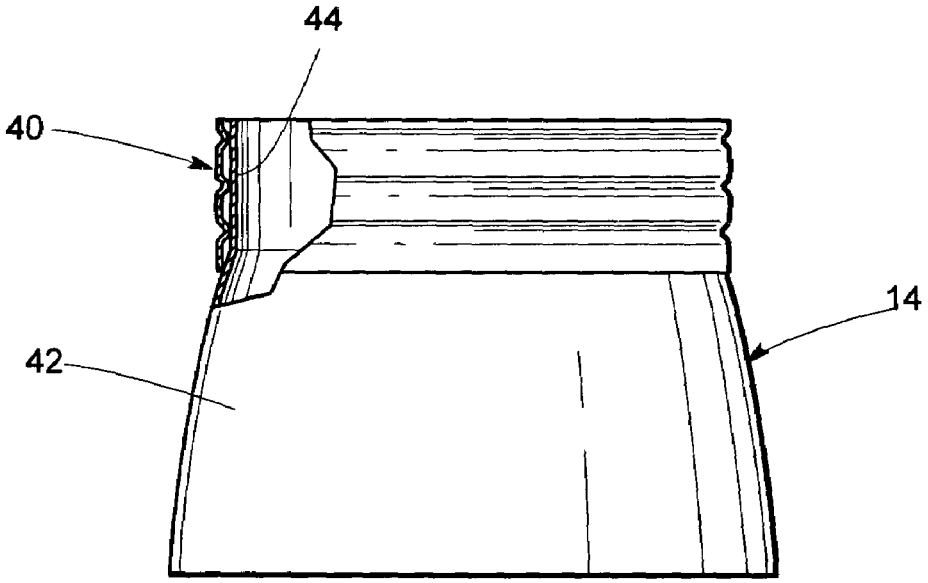
FIG. 8 is an assembly view of the inner reflector of the invention and partially cut away to reveal a detail view of an expedient for connecting structural portions of the inner reflector together.

As is additionally seen in FIGS. 7 and 8, the inner reflector 14 is essentially formed of a reflector portion 42 and a surmounting cylindrical portion 44, the cylindrical sleeve 40 essentially being mounted to the cylindrical portion 44 of the inner reflector 14. As can be seen in the detail of FIG. 8, peripheral portions of the cylindrical portion 44 flare outwardly at outer peripheral edges thereof and essentially friction fit to upper inner surfaces of the cylindrical sleeve 40, thereby to mount the cylindrical sleeve 40 to the inner reflector 14. The inner reflector 14 can be configured to include the structure of the sleeve 40 integrally therewith without departing from the scope of the invention.

Figure 10:
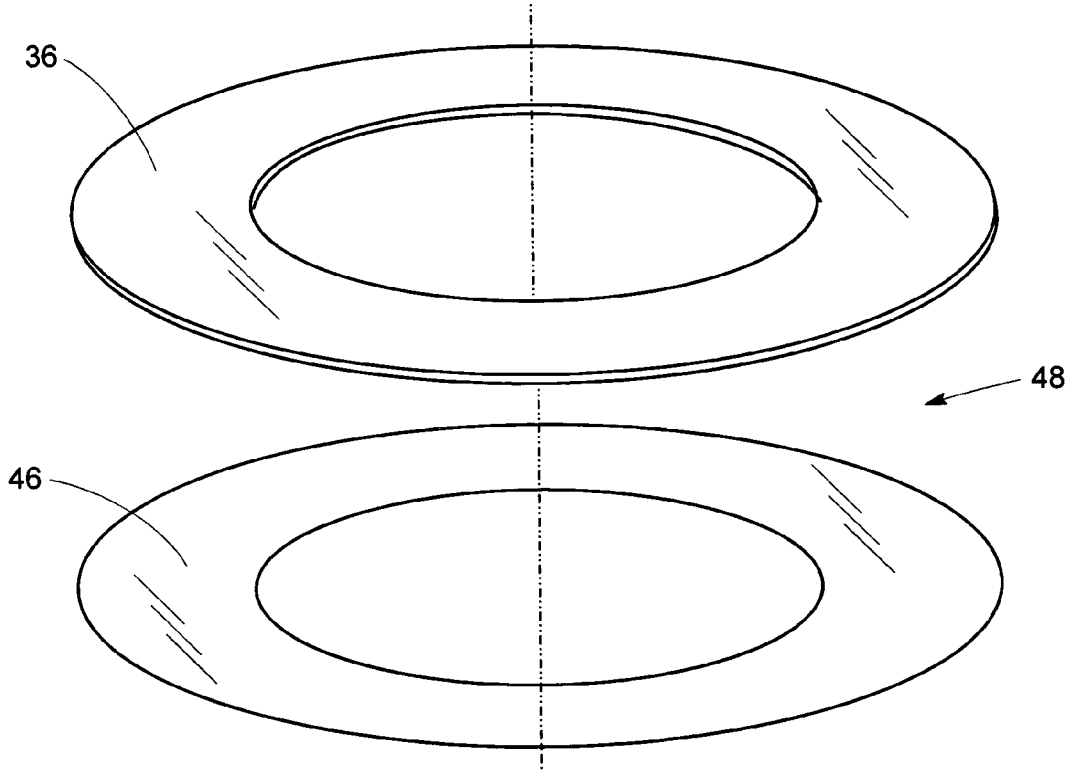
FIG. 10 is a perspective view of an light altering annulus and associated film forming a light altering assembly configured according to the invention.
Figure 11:
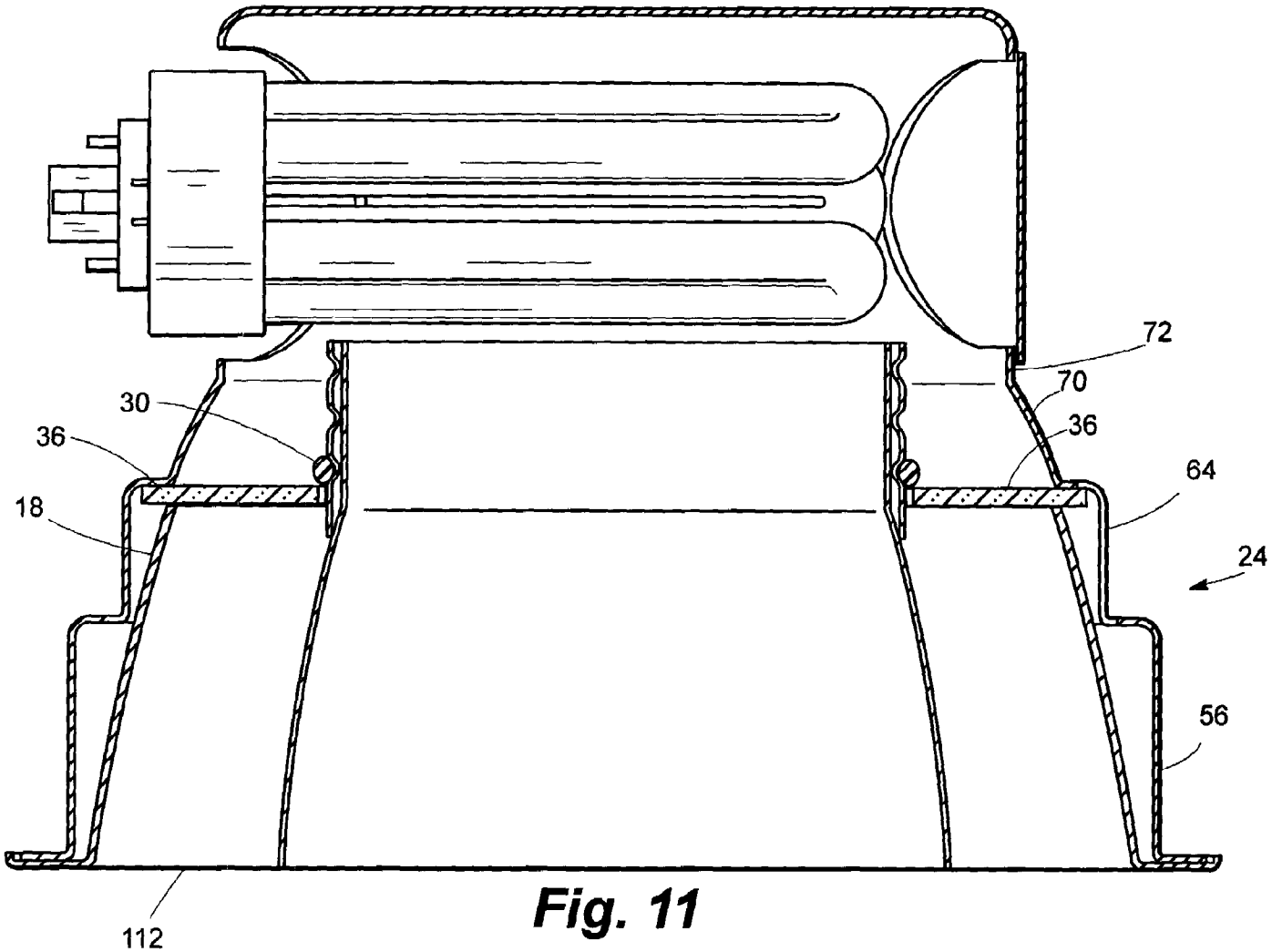
FIG. 11 is a side elevational view taken through the luminaire of FIG. 2 along a first plane.
Figure 12:
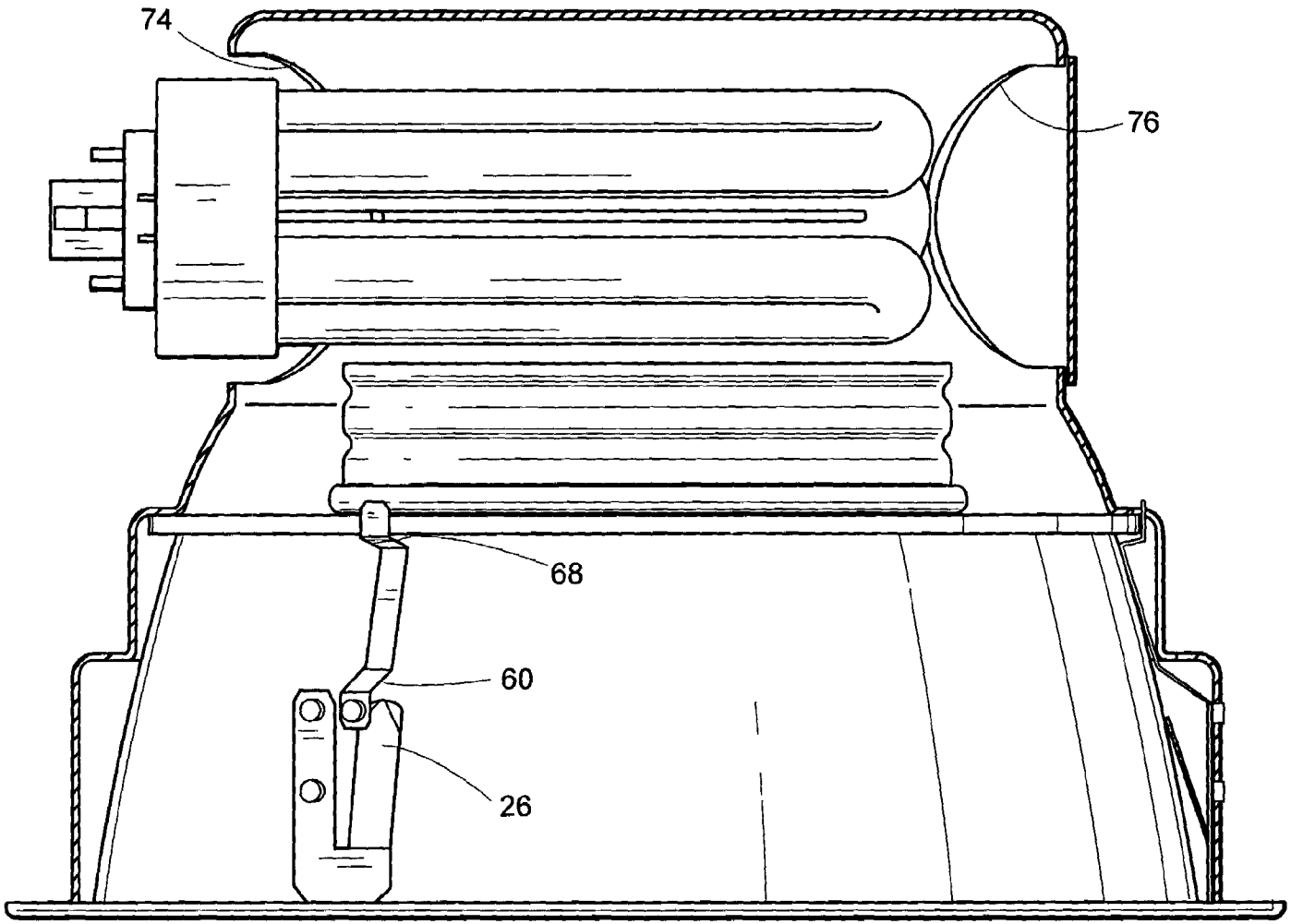
FIG. 12 is a side elevational view taken through the luminaire of FIG. 2 along a second plane.

Referring now also to FIGS. 11 and 12 in addition to FIGS. 3 through 5 inter alia, the annulus element 36 is seen in greater detail and further in a perspective view in FIG. 10, the annulus element 36 essentially comprising a transparent or translucent element formed of glass or plastic, such as acrylic plastic or the like, the function of the annulus element 36 in addition to supporting the O-ring 30 and thus the inner reflector 14 in place within the luminaire 10 being to alter light from the lamping 22 that exits the aperture 15 of the luminaire 10 in the vicinity of the annulus of light at 13. That light existing at 13 essentially passes between outer surfaces of the inner reflector 14 and the reflective surfaces 21 of the outer reflector 18, this light so passing having been altered as to color and/or other characteristics by means of the annulus element 36 either by virtue of integral color provided in the annulus 36 such as by pigmentation of the glass or plastic material forming the annulus element 36 or by a provision of a coating or film such as the film 46 disposed either on upper or lower surfaces of the annulus element 36. It is preferred according to the invention to use a translucent film such as the PVC film produced by Oracal USA, a division of LIG International, Inc., of Jacksonville, Fla., and such as is marketed under the trade name Series 8500 inter alia, transparent films also being usable. The films so identified are colored in a variety of colorations and provided with silk-matte surface finishes which inhibit undesired reflection. Further, film such as the film 46 can be provided with adhesive such as polyacrylate adhesives on one side thereof to permit easy attachment to a surface, preferably an under surface, of the annulus element 36. The luminaire 10 can be readily customized as to coloration of the light emitted at the annulus 13 by simple removal of one of the annulus elements 36 having a film of one color and substitution of another annulus element having a film of another color. Particularly effective illumination is provided through the use of films having rich blue colorations which produce a blue annulus of light about a white shaft of light represented by the beam 12 as best seen in FIG. 1. However, it is to be understood that any desired color can be used. It is to be understood that the use of the film 46 as indicated above is preferable. However, coloration can be imparted to the annulus of light at 13 other than by the use of a film such as the film 46. As is seen in FIG. 10, the annulus element 36 is seen to be spaced from the film 46, the film 46 essentially being formed in an identical configuration such that the annulus element 36 and the film 46 can be mounted together to form a light-altering assembly 48. It is further to be understood that either the annulus element 36 or the light-altering assembly 48 can be chosen to alter the wavelength of light passing therethrough in order to provide a desired characteristic of the light passing out of the luminaire 10 in the annulus at 13, such materials capable of altering wavelength being known in the art.

Figure 6:
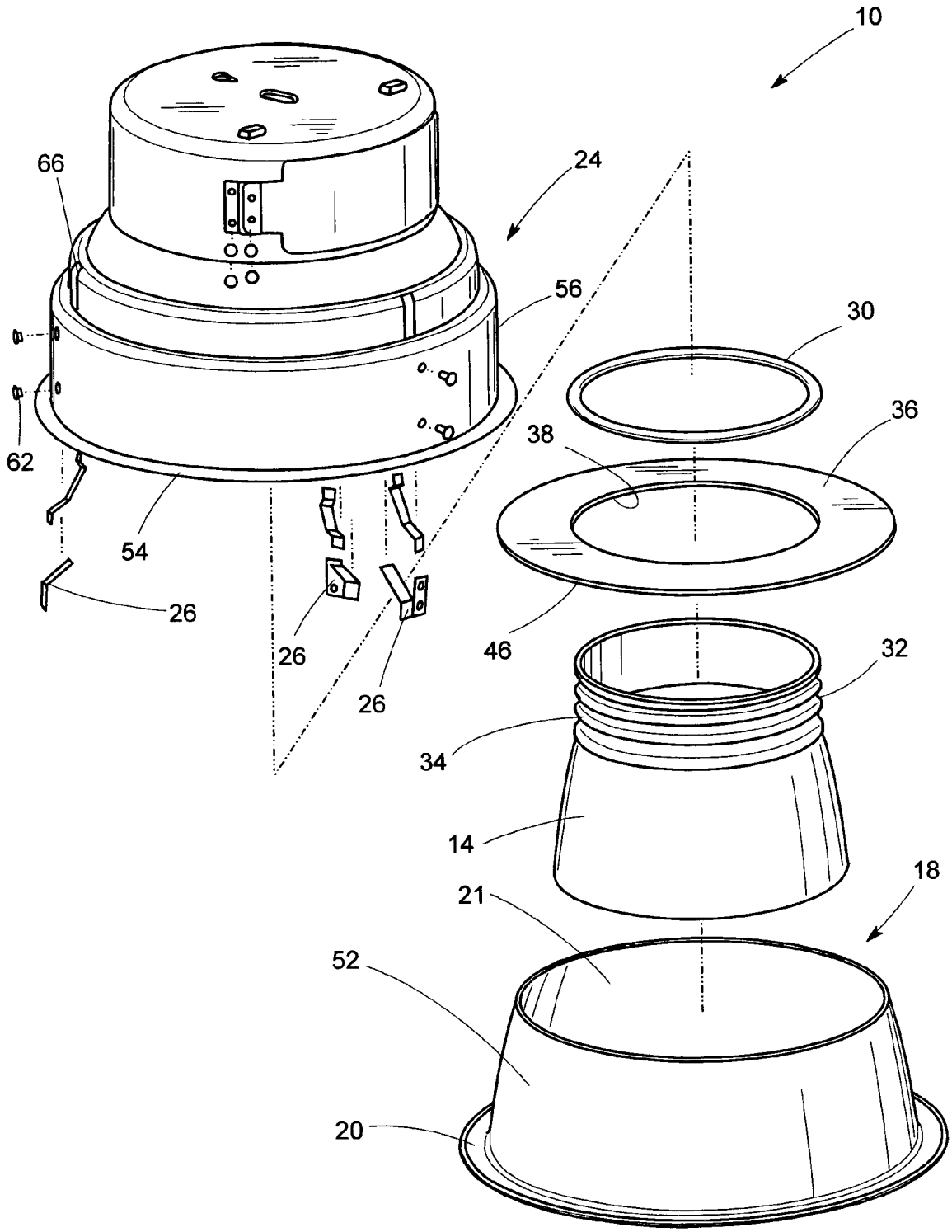
FIG. 6 is an exploded view illustrating the relationship of the structural elements of a preferred embodiment of the invention.

As can best be seen in FIGS. 3 through 5, as well as in the exploded view of FIG. 6 and further in the side elevations of FIGS. 11 and 12, lamping 22 can be seen to take the form of compact fluorescent lamps such as Triple Tube lamps as are available commercially. Such lamps are manufactured by General Electric and Sylvania inter alia. Luminaires configured according to the invention are typically provided with from one to three lamps, the embodiment shown in the drawings thus far referred to having two lamps 50, both lamps typically being of the same wattage with usual wattages being between 18 and 57 watts. When a single lamp 50 is utilized, that lamp can be chosen to be a 57 watt lamp inter alia. In embodiments using three lamps (not shown), lamp wattages are selected between 18 watts and 42 watts in typical luminaires. As is seen in the drawings, the lamps 50 are seen to be horizontally mounted, horizontal orientations being preferred due to restrictions on the height of luminaires such as luminaire 10. It is to be understood that vertically oriented lamping can be provided as is described hereinafter relative to a further embodiment of the invention. In preferred embodiments, light produced by a single tamping group such as the lamping 22 yields the light passing through both the inner reflector 14 and the outer reflector 18. It is to be understood, however, that two separate light sources can be provided to accomplish these respective functions. It is further to be noted that a highly specular reflector (not shown) can be provided in upper portions of the housing 24 in order to direct a greater proportion of generated light through the aperture 15 of the luminaire 10. However, introduction of a specular reflector in that region may generate lamp images of a character that would need to be accommodated in order to provide the best possible appearance of that light passing through the inner reflector 14. Disposition of a lens or diffuser (not shown) at lower portions of the inner reflector 14 or even at innermost portions of the inner reflector 14 can be employed to obviate the visual effects of lamp images. However, use of diffusing lenses in this manner reduces lighting efficiency.

Figure 9:
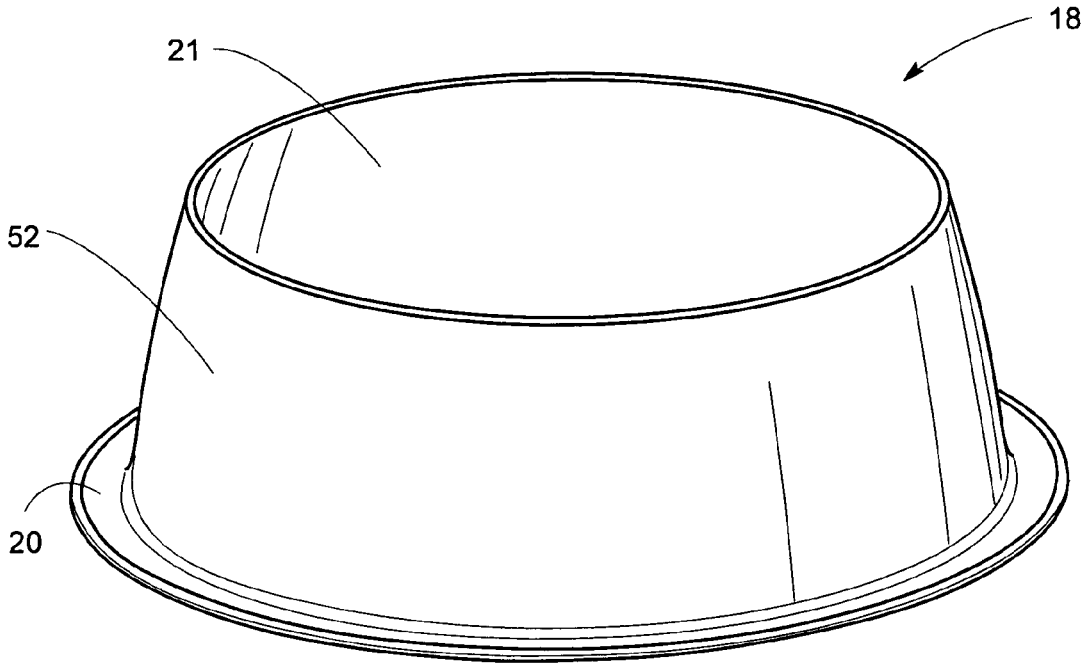
FIG. 9 is a perspective view of an outer reflector configured according to a preferred embodiment of the invention.
Figure 13:
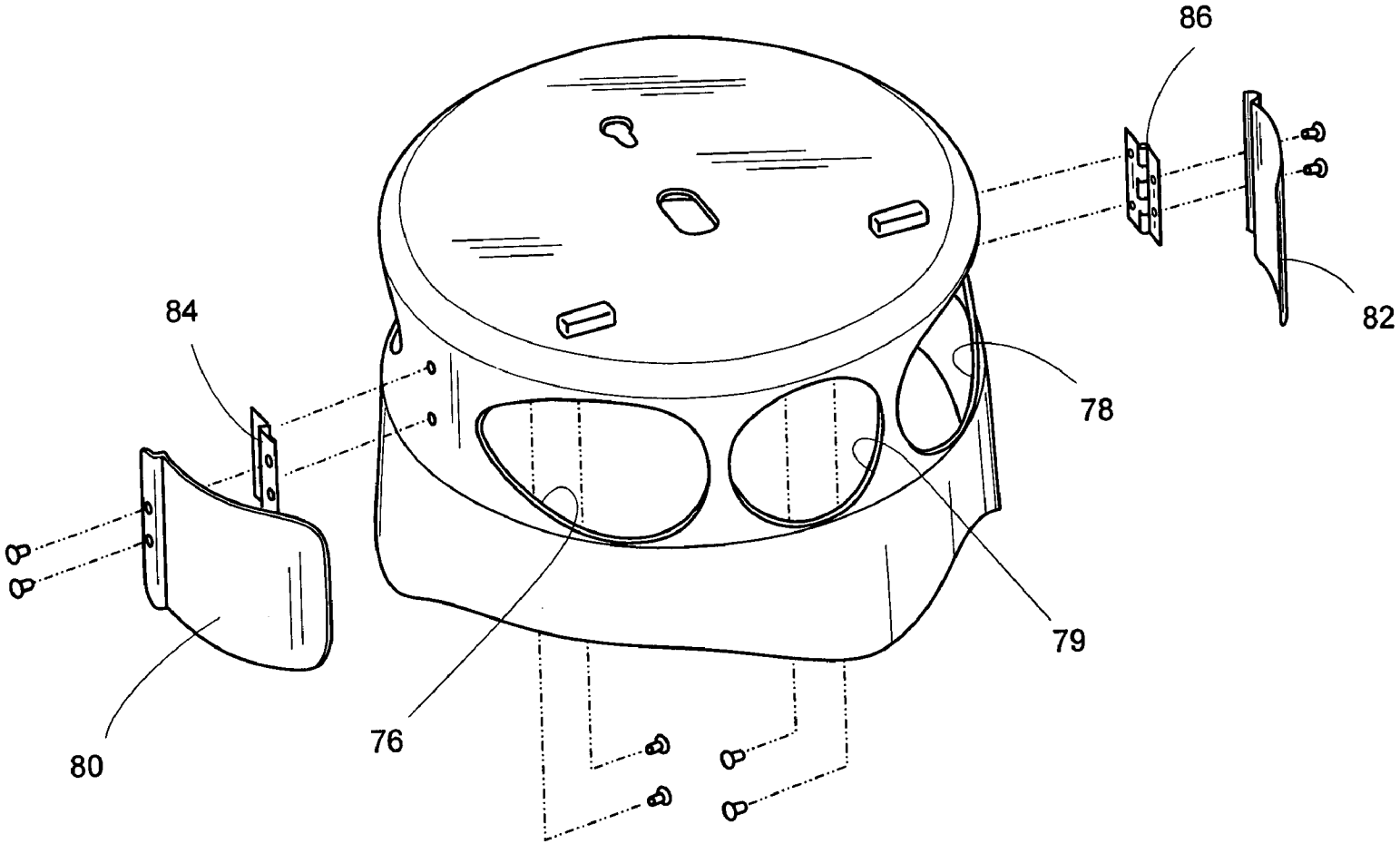
FIG. 13 is a detail perspective view of a portion of the luminaire housing illustrating light-sealing doors.

Referring now to FIG. 9 as well as to FIG. 6, the outer reflector 18 is seen to be comprised of a body portion 52 to which the annular flange 20 is formed about lower perimetric edges thereof, inner surfaces of the body portion 52 essentially constituting the reflective surfaces 21 mentioned hereinabove. As is seen particularly in FIGS. 11 and 12 with reference to FIG. 6, the clips 26 function to mount the outer reflector 18 to the housing 24. An annular flange 54 formed about lower peripheral edges of a lower cylindrical body portion 56 of the housing 24 has spaced apertures (not shown) formed therein for receipt of portions of the clips 26, free portions of the clips 26 contacting outer surfaces of the outer reflector 18 to hold said reflector 18 within the housing 24. Clips 60 fixed to the housing 24 at one end by rivets 62 are disposed in spaced relation about inner surfaces of the housing 24 at upper portions of the cylindrical body portion 56 and extend upwardly and inwardly of interior cylindrical body portion 64 of the housing 24, the body portion 64 having spaced elongated openings 66 formed therein in juxtaposed relation to the clip 60 such that free ends of the clips 60 can be biased outwardly through manual manipulation so as to release the annulus element 36 for replacement of the element 36 or for substitution of a film 46 of a differing color for a film previously mounted by the annulus element 36, thereby to customize the luminaire 10 as to color of that light passing through the annulus at 13. It is to be seen that the clips 60 each have a supporting ledge 68 against which the annulus element 36 rests. The clips 60 are formed of a spring steel or other resilient material so that the clips 60 bias inwardly to maintain the annulus element 36 in place but which can be bent outwardly as aforesaid to release the annulus element 36. The housing 24 further comprises a body portion 70 having the shape of a spherical section, the body portion 70 being surmounted by a cylindrical end portion 72 into which the lamping 22 extends through a radially directed aperture 74 formed over outer surfaces of the end portion 72. As also seen in FIG. 13, apertures 76 and 78, respectively covered by lamp doors 80 and 82, allow clearance for the lamping 22, the lamp doors 80 and 82 being respectively mounted by spring-loaded hinges 84 and 86. The mounting of the hinges 84 and 86 to permit operation of the lamp doors 80, 82 respectively is shown in FIG. 13. The lamp doors 80, 82 also function to close off the apertures 76 and 78 to prevent light leakage through said apertures 78, 79 and 80. It is to be noted that inner surfaces of the housing 24 are preferably coated with a reflective white paint or the like, and especially inner surfaces of the body portion 70, so that light incident on such surfaces is more efficiently reflected through either the inner reflector 14 or the outer reflector 18.

Figure 14:
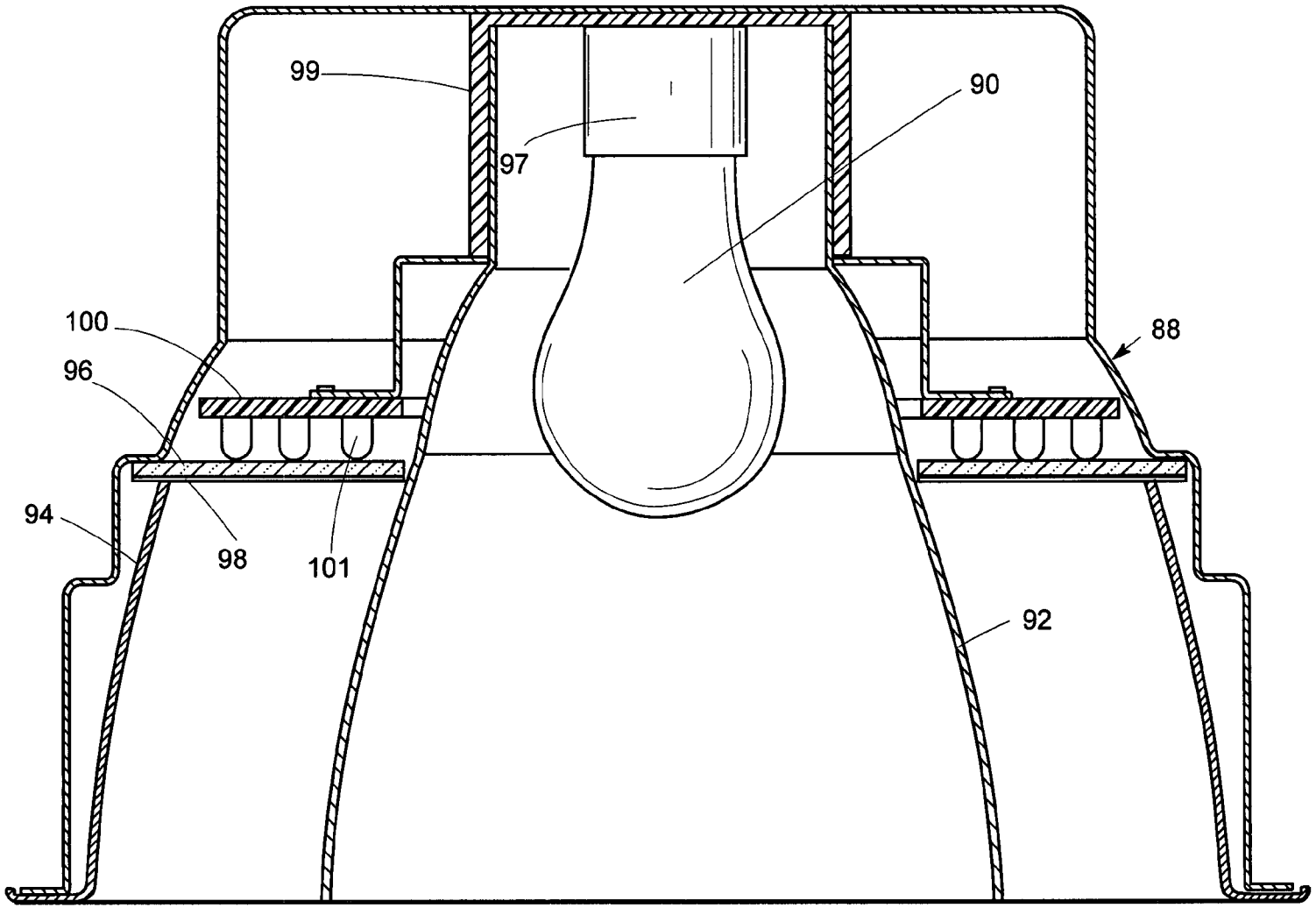
FIG. 14 is a side elevational view in section of a further embodiment of the invention utilizing light emitting diodes as a light source.

Referring now to FIG. 14, a luminaire 88 configured according to another embodiment of the invention is provided with a vertically oriented incandescent light source 90, the light source 90 providing white light that exits luminaire 88 through inner reflector 92, the inner reflector 92 essentially being identical in conformation to the inner reflector 14 described hereinabove. The luminaire 88 is further configured to include an outer reflector 94 essentially identical to the outer reflector 18 described hereinabove. Between the reflectors 92, 94, an annulus element 96 is disposed and mounted such as according to the description given above relative to the mounting of the annulus element 36. The annulus element 96 can have a film 98 formed on a lower surface thereof which is identical to those films described as being suitable for use as the film 46 referred to hereinabove, for example. An array 100 of light emitting diodes 101 is provided in surmounting relationship to the annulus element 96 with the individual light emitting diodes 101 being preferably mounted in spaced relation just above the annulus element 96. The LEDs 101 can be configured to produce light of differing color, it being possible to select light emitting diodes that emit green, blue and other colors so as to produce a colored annulus of light emanating from the luminaire 10 between the inner reflector 92 and the outer reflector 94. In order to provide the richest quality of light from the LEDs 101, it is typically desirable to close off upper portions of the inner reflector 92 such as with a header cap 99 and to dispose the light source 90 within the confines of the inner reflector 92 and mounted by socket 97, When the LEDs 101 are chosen to be blue LEDs as is described in U.S. Pat. No. 5,640,792, it is possible to form the annulus element 96 and/or the film 98 of a material as is described in the aforesaid patent in order to alter the wavelength of light emitted by such light emitting diodes, thereby to produce an annulus of light of a wavelength altered from that light originally produced by the LEDs 101. U.S. Pat. No. 5,640,792 is therefore incorporated hereinto by reference. It is also possible in the embodiment of FIG. 14 to provide an annulus element 96 that diffuses the colored light produced by the LEDs 01, no color being therefore imparted to light emanating from the luminaire 88 from any pigmentation contained in the annulus element 96.

Figure 15:
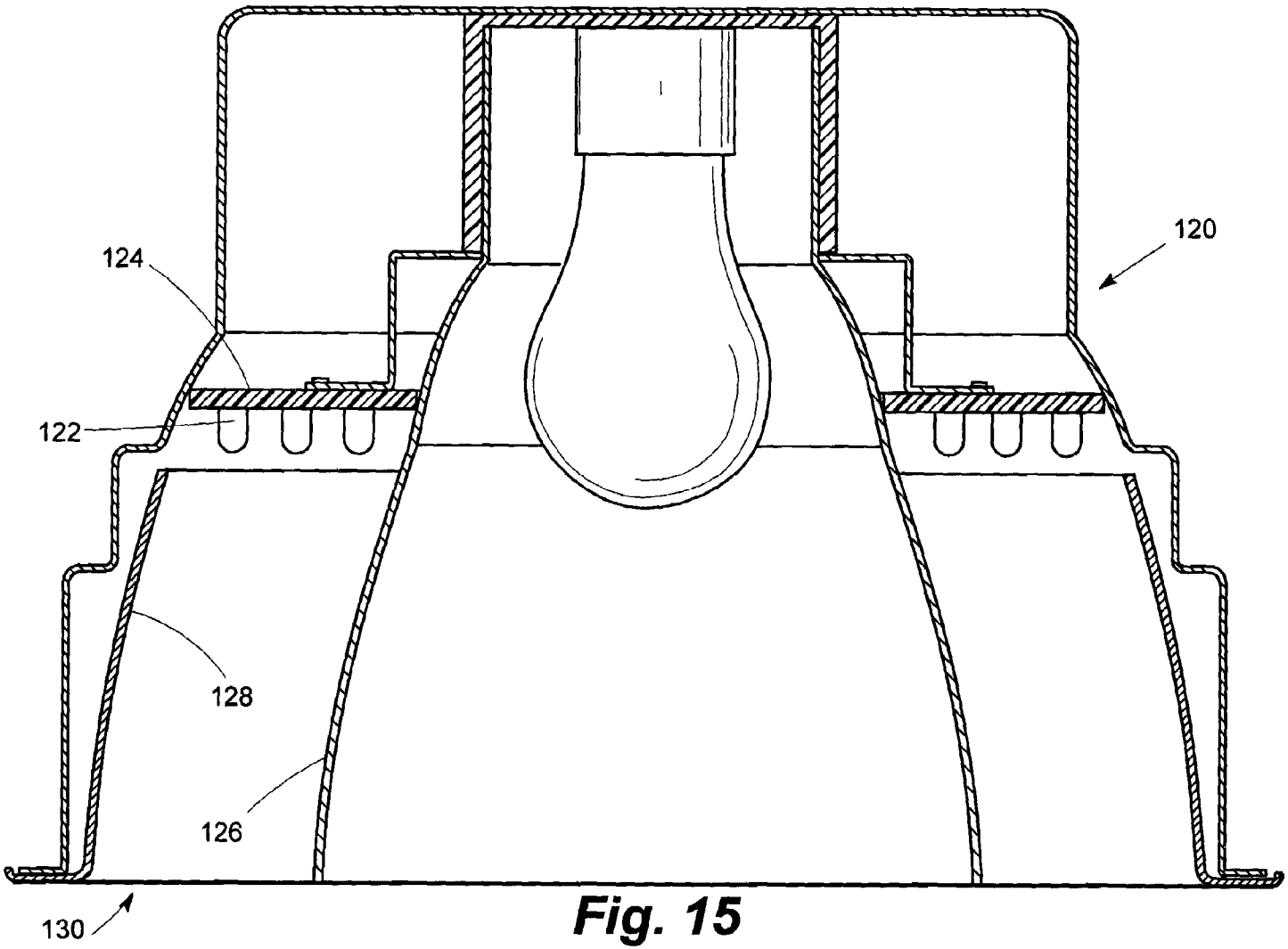
FIG. 15 is a side elevation in section of yet another embodiment of the invention utilizing light emitting diodes as a light source.

Referring now to FIG. 15, a luminaire 120 is seen to be similar to the luminaire 88 of FIG. 14 with a primary exception being that an array of light emitting diodes 122 are mounted by an annular plate 124 between an inner reflector 126 and an outer reflector 128. The annulus of colored light emanating from between the reflectors 126, 128 at 130 will exhibit a scalloped pattern on outer surfaces of the inner reflector 126 and on inner surfaces of the outer reflector 128, an unusual affect that is decorative in nature additionally to the annulus of colored light that is apparent to a viewer at 130. The annular plate 124 can be mounted within the interior of the luminaire 120 as is described herein relative to the mounting of the annulus element 36 of the embodiment shown in FIGS. 1 through 13.

The light emitting diodes chosen for use in the embodiments of FIGS. 14 and 15 can be of a single color or can be of different colors depending upon the affect intended by a user of the luminaires 88 and 120.

Figure 16:
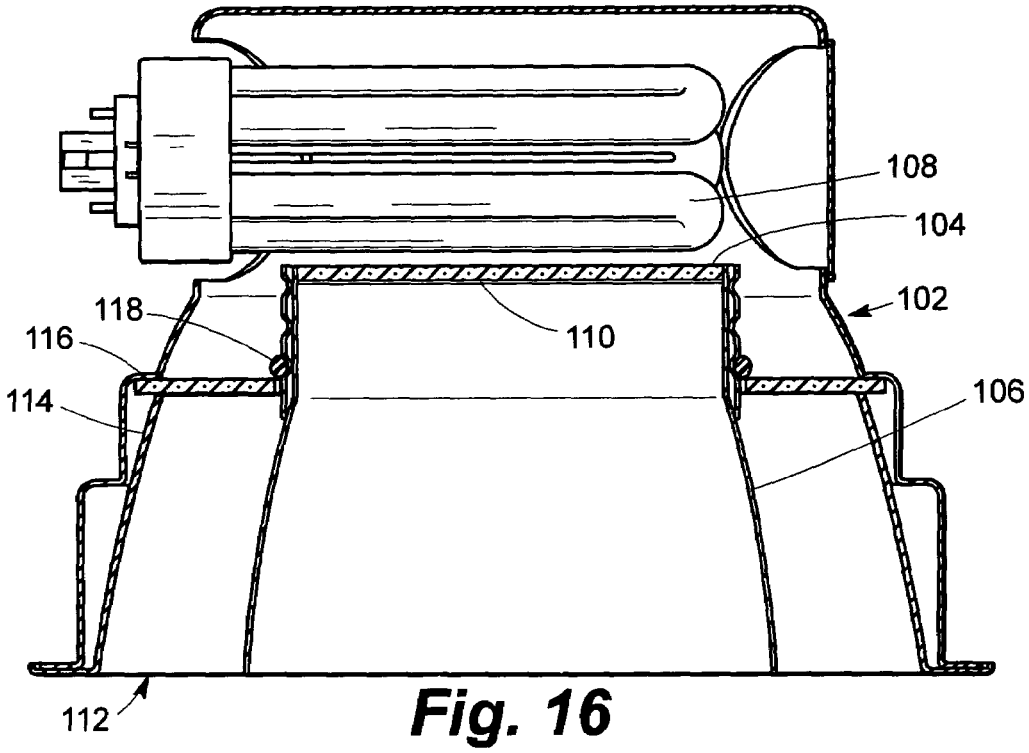
FIG. 16 is a side elevational view in section of a luminaire configured according to a further embodiment of the invention.

Referring now to FIG. 16, a luminaire 102 configured according to the invention is seen to be similar to the luminaire 10 with the exception of the provision of a disc 104 disposed in proximity to uppermost edges of an inner reflector 106, the disc 104 acting to alter light produced by lamping 108 either by means of pigmentation provided in the disc 104 or by the disposition of a film 110 thereon, the film 110 being essentially identical to the film 46 described hereinabove. In the embodiment of FIG. 16, the luminaire 102 thus provides a colored light emanating from the inner reflector 106 and white light emanating from an annulus at 112 located between the inner reflector 106 and an outer reflector 114. In most other respects, the luminaire 102 is otherwise identical to the luminaire 10. In order to mount the inner reflector 106 within the luminaire 102, an annular plate 116 is used in cooperation with an O-ring 118 essentially as is described herein relative to the cooperation of the annulus element 36 with the O-ring 30 relative to the embodiment shown in FIGS. 1 through 13.

Figure 17:
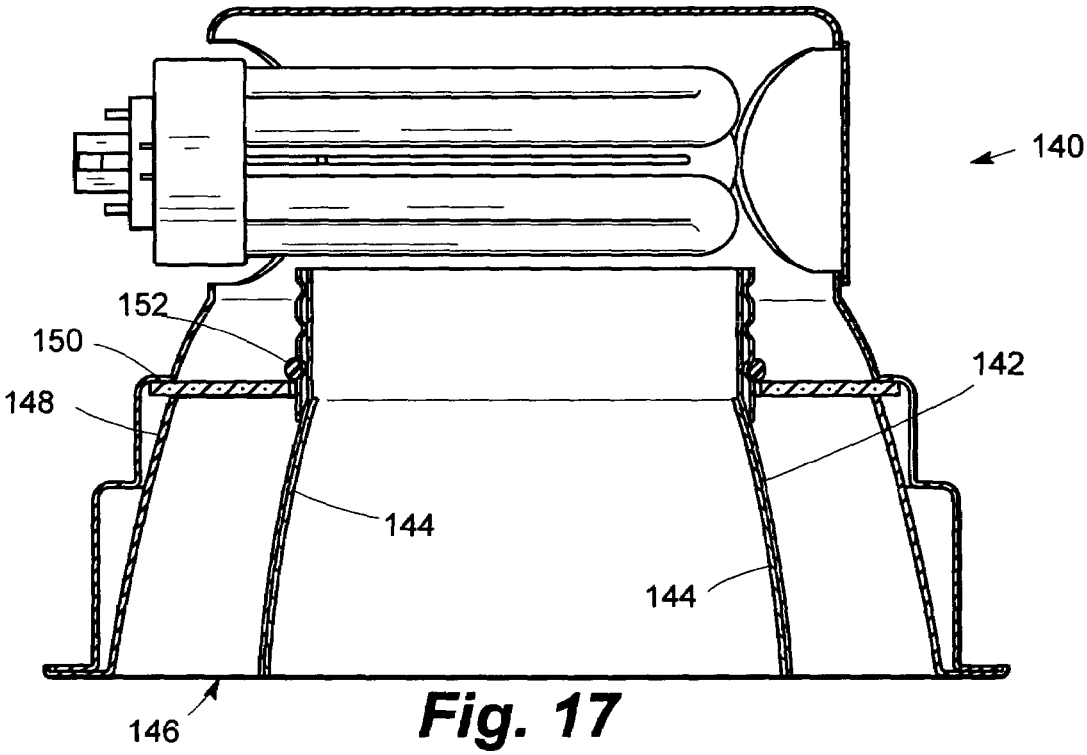
FIG. 17 is a side elevational view in section of a luminaire configured with anodized coloration provided on inner surfaces of an inner reflector according to another embodiment of the invention.

As can be seen in FIG. 17, a luminaire is at 140 to be configured in a manner essentially identical to the embodiment shown in FIGS. 1 through 13. Inner reflector 142, however, is formed with a layer 144 or coating of a colored anodized or similar material which yields a distinctive hue, such as a wheat coloration, thereby causing the beam of light exiting the inner reflector 142 to have a decorative appearance that is pleasing to the eye of an observer. The layer 144 could be formed of a colored, reflective paint or similar material. In other respects, an annulus of light emanating at 146 between the inner reflector 142 and an outer reflector 148 is colored and/or altered by means of annulus element 150 configured as has been described in detail herein relative to the annulus element 36. An O-ring 152 can similarly be used in association with the annulus element 150 for mounting of said annulus element 150 within the luminaire 140 as has been described relative to corresponding structure described herein relative to the embodiment of the invention shown in FIGS. 1 through 13.

Figure 18:
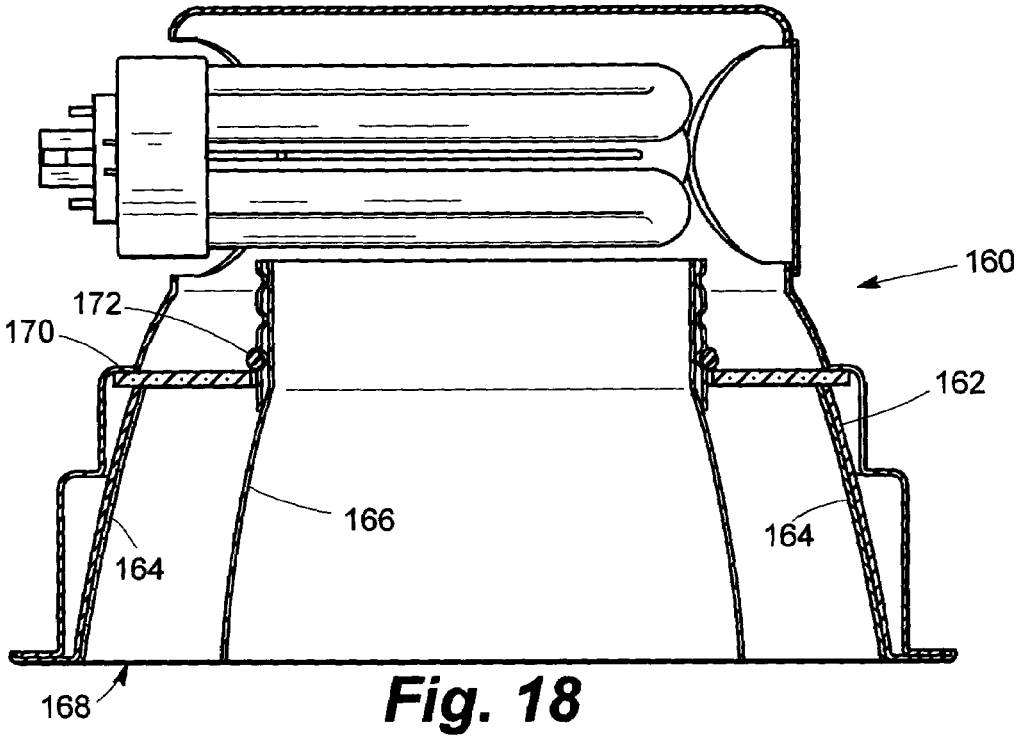
FIG. 18 is a side elevational view in section of a luminaire configured with a colored paint or coating formed on inner surfaces of an outer reflector according to a further embodiment of the invention.

Referring now to FIG. 18, a luminaire is seen at 160 to be configured in a manner essentially identical to the embodiment of the invention shown in FIGS. 1 through 13. Outer reflector 162, however, has inner surfaces thereof coated with a layer 164 of a colored, reflective anodized material or a reflective, colored paint or similar material, thereby causing coloration of an annulus of light emanating from between the outer reflector 162 and an inner reflector 166 at 168 to be caused by said layer 164. The luminaire 160 has an annular plate 170 disposed between the outer reflector 162 and the inner reflector 166, the plate 170 functioning in association with an O-ring 172 as noted herein to mount the inner reflector 166 within the luminaire 160. However, the annular plate 170 is not provided as intended in the luminaire 160 to contribute to coloring of the annulus of light passing from the luminaire 160 at 168. As an alternative, however, the plate 170 could take the form of the annulus plate 36 and associated film 46 as described herein relative to the embodiment of the invention shown in FIGS. 1 through 13. In such an alternative embodiment, both the layer 164 and an annulus element such as the annulus element 36/film 46 would contribute to coloring of the light passing from the luminaire 160 at 168.

Figure 19:
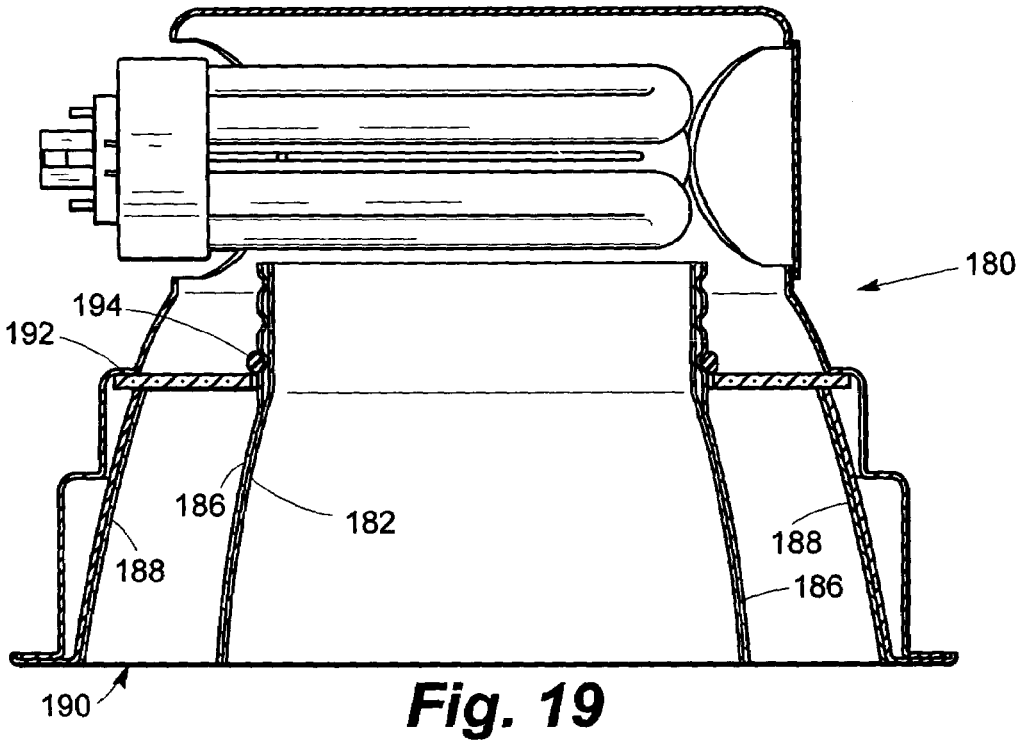
FIG. 19 is a side elevational view in section of a luminaire configured with a colored paint or coating formed on surfaces of inner and outer reflectors according to yet another embodiment of the invention.

As can now be seen with reference to FIG. 19, a luminaire is seen at 180 to be formed of an inner reflector 182 and an outer reflector 184, outer surfaces of the inner reflector 182 and inner surfaces of the outer reflector 184 respectively having layers 186 and 188 formed thereon, the layers 186 and 188 being reflective, colored paint or a colored anodized material. Coloring of that light exiting from the luminaire 180 at 190 occurs due to the layers 186 and 188 rather than due to the function of structures such as the annulus element 36/film 46 described herein relative to the embodiment of the invention shown in FIGS. 1 through 13. An annular plate 192 is seen to function in association with an O-ring 194 to mount the inner reflector 182 within the luminaire 180 as described relative to similar structure shown in FIG. 18 inter alia.

Figure 20:
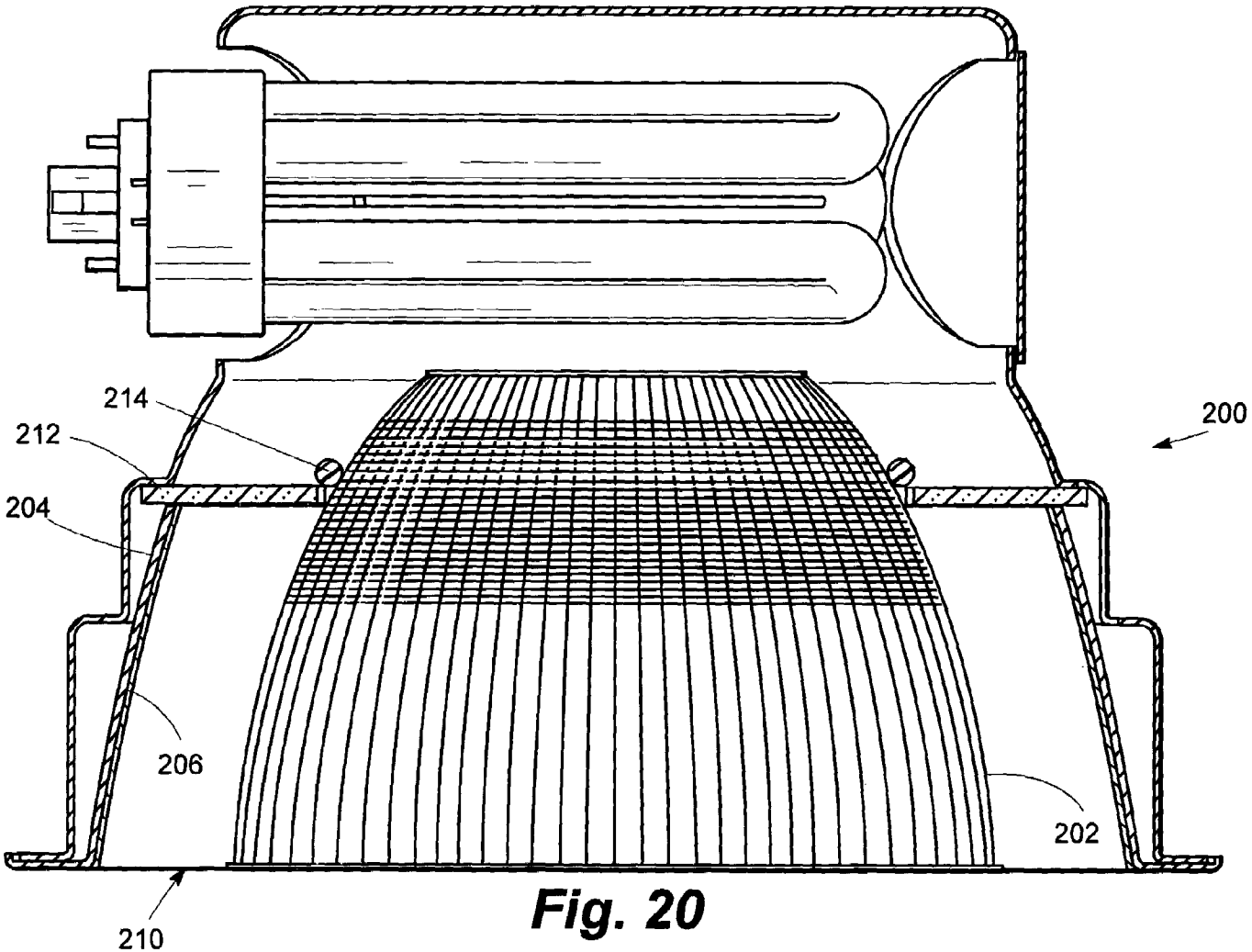
FIG. 20 is a side elevational view in partial section of a luminaire configured with an inner reflector formed of a prismatic light-transmissive material and having inner surfaces of an outer reflector coated with a colored paint or coating according to a still further embodiment of the invention.

Referring now to FIG. 20, a luminaire is seen at 200 to have an inner reflector 202 which takes the form of a fluted, prismatic reflective structure manufactured of a light-transmissive material such as glass or a "plastic" such as acrylic or polycarbonate or the like. An outer reflector 204 has a layer 206 of a reflective, colored paint or a colored anodized material formed on inner surfaces thereof, colored light thus produced within that space between the inner reflector 202 and the outer reflector 204 "bleeding" through the inner reflector 202 to colorize and thus alter the coloration of that light exiting the inner reflector 202 at 208. That light exiting the luminaire at 210 is colored due to the function of the layer 206 as has been noted herein. Coloration of the light between the inner reflector 202 and the outer reflector 204 can alternatively or additionally be accomplished through use of an annulus element such as the annulus element 36/film 46 referred to herein. However, annular plate 212 can be configured so as not to contribute to coloring of the light at 210 but can merely function in association with O-ring 214 to mount the inner reflector 202 within the luminaire 200 as has been described relative to corresponding structure described herein.

Figure 21:
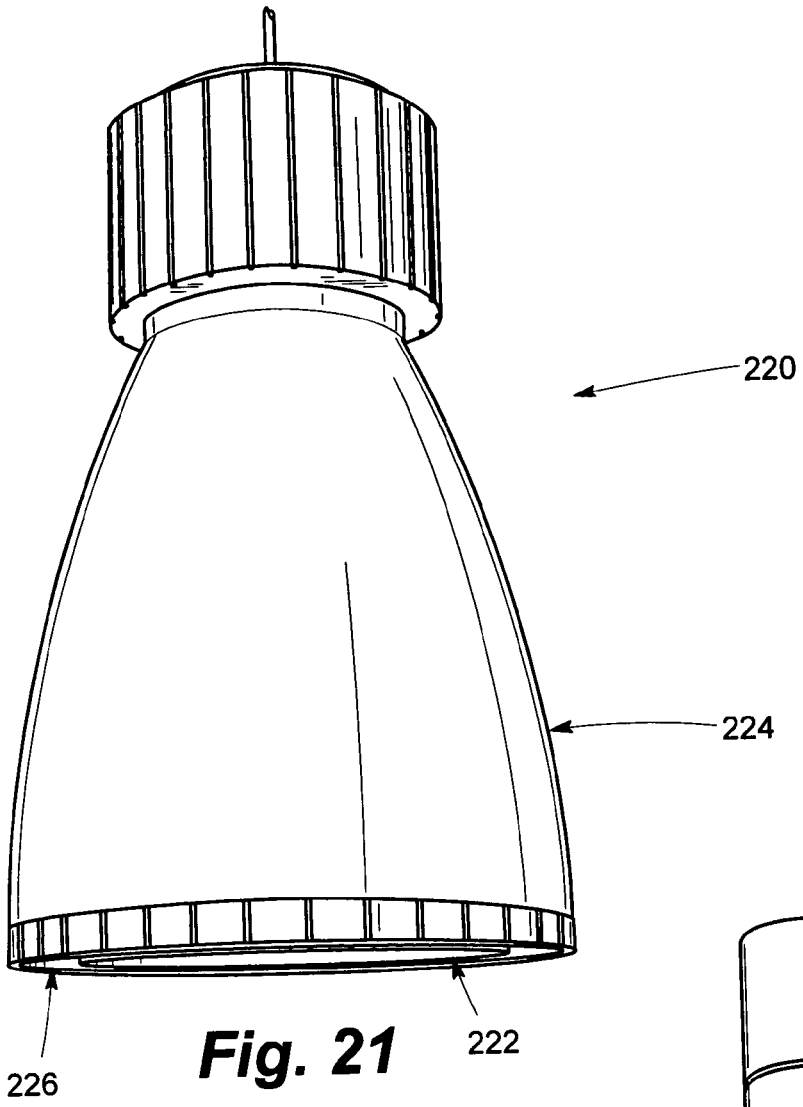
FIG. 21 is a perspective view of a decorative pendant luminaire configured according to the invention; and, FIG. 22 is a perspective view of a decorative pendant luminaire having an outer reflector formed of a prismatic light-transmissive material and configured according to yet another embodiment of the invention.
Figure 22:
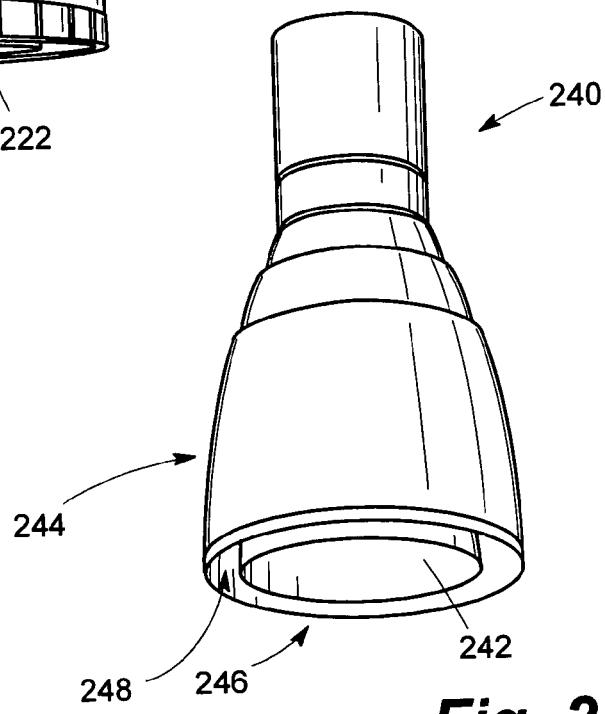

As can be seen in FIGS. 21 and 22, luminaires seen respectively at 220 and 240 can be configured according to the invention as pendent-mounted luminaires suspended from rigid tubular elements or flexible wires as is conventional in the art. The luminaire 220 has an inner reflector 222 mounted within an outer reflector 224, the outer reflector 224 also conveniently serving as a housing for the luminaire 220. An annulus of colored light exits the luminaire 220 at 226 as described herein relative to other embodiments of the invention, internal structure disposed within the outer reflector 224 being essentially identical to that described herein relative to downlighting embodiments of the invention. In the luminaire 220, a central beam of white light preferably exits the inner reflector 222 and "floats" in an annular beam of colored light at 226. In the luminaire 240 of FIG. 22, an inner reflector 242 is carried by an outer reflector 244 that also serves as a housing, the outer reflector 244 taking the form of a prismatic reflector formed of a light-transmissive material such as glass or a "plastic" such as an acrylic or a polycarbonate as examples. In the luminaire 240, a central beam of preferably white light exits the inner reflector 242 at 246 while a colored annulus of light is intended to exit the luminaire 240 between the inner reflector 242 and the outer reflector 244 at 240. However, a decorative "glow" through the outer reflector 244 is also visible to an observer and creates an additional decorative affect.

It is to be understood that the scope of the present invention extends other than to the explicit descriptions of the specific embodiments of the invention, modifications and variations being apparent in light of the foregoing disclosure to those of ordinary skill in the art. As can be seen through reference to the embodiments of the invention that are explicitly described, it can be appreciated that the concepts of the invention can be embodied in varying kinds of luminaires including downlighting luminaires and pendent-mounted luminaires, as well as similar track-mounted luminaires and the like. Further, the various embodiments shown and described can be employed in such other kinds of luminaires. Accordingly, the scope of the invention is defined according to the recitations of the appended claims.

What is claimed is:

1. A luminaire capable of providing illumination having differing uses, comprising:

at least one source of light carried by the luminaire;

a first reflector disposed within the luminaire and carried thereby, at least a portion of the light generated by the at least one source of light exiting an aperture of the first reflector;

a second reflector carried by the luminaire and disposed about the first reflector, inner surfaces of the second reflector being spaced from outer surfaces of the first reflector about said first reflector thus forming an annulus therebetween at an aperture of the second reflector, at least a portion of the light generated by the at least one source of light exiting the luminaire through the annulus; and, light altering means carried by the luminaire and disposed between the first and second reflectors and spaced from the annulus for changing the character of that light exiting the luminaire through the annulus to thereby provide a decorative effect.

2. The luminaires of claim 1 wherein the light altering means are disposed in proximity to upper portions of the reflectors.

3. The luminaire of claim 2 wherein the at least one source of light is disposed in proximity to the light altering means.

4. The luminaire of claim 1 wherein the light altering means comprises a colored annular plate through which light exiting the annulus passes and is colored by the light altering means.

5. The luminaire of claim 1 wherein the light altering means comprises a light transmissive plate and a colored film disposed on the plate for coloring light passing through the plate and the film.

6. The luminaire of claim 1 wherein the light source is horizontally mounted in surmounting relation to the reflector.

7. The luminaire of claim 1 and further comprising means for adjustably mounting the first reflector in different positions within the luminaire.

8. The luminaire of claim 7 wherein at least some of the positions in which the first reflector is mounted causes perimetric edges thereof defining the aperture of said first reflector to extend from an aperture of the luminaire.

9. The luminaire of claim 7 wherein at least one of the positions in which the first reflector is mounted causes perimetric edges thereof defining the aperture of said first reflector to be flush with an aperture of the luminaire.

10. The luminaire of claim 7 wherein the mounting means comprises a sleeve carried by the first reflector, the sleeve having corrugations formed thereon, and an annular band disposable in relation to each one of the corrugations and contacting an annular plate mounted between the reflectors, the first reflector being positioned by disposition of the annular band relative to any particular one of the corrugations.

11. The luminaire of claim 10 and further comprising means for mounting the annular plate within the luminaire.

12. The luminaire of claim 10 wherein the annular plate comprises the light altering means.

13. The luminaire of claim 12 wherein the annular plate is colored.

14. The luminaire of claim 12 wherein the annular plate is formed of a light transmissive material and the light altering means further comprises a colored film disposed on the plate for coloring light passing through the plate and the film.

15. The luminaire of claim 1 wherein the light altering means comprises a colored reflective layer formed on at least portions of inner surfaces of the outer reflector.

16. The luminaire of claim 15 wherein the colored reflective layer comprises a reflective paint.

17. The luminaire of claim 15 wherein the colored reflective layer comprises an anodized material.

18. The luminaire of claim 15 wherein the outer reflector is formed of a light-transmissive material.

19. The luminaire of claim 18 wherein the outer reflector has prismatic structures formed thereon.

20. The luminaire of claim 19 wherein the outer reflector comprises an outer housing of the luminaire.

21. The luminaire of claim 15 wherein the light altering means comprises a colored reflective layer formed on outer surfaces of the inner reflector.

22. The luminaire of claim 1 wherein at least portions of inner surfaces of the first reflector have a colored reflective layer formed thereon.

23. The luminaire of claim 22 wherein the layer comprises an anodized material.

24. The luminaire of claim 22 wherein the light altering means further comprises a colored reflective layer formed on inner surfaces of the outer reflector.

25. The luminaire of claim 1 wherein the first reflector is formed of a light transmissive material.

26. The luminaire of claim 25 wherein the light altering means comprises a colored reflective layer formed on at least portions of the inner surfaces of the outer reflector.

27. The luminaire of claim 1 and further comprising means for mounting the luminaire in a recessed disposition in a ceiling.

28. The luminaire of claim 1 and further comprising means for pendantly mounting the luminaire.

29. The luminaire of claim 1 wherein the light source is vertically mounted within the luminaire.

30. A luminaire capable of providing illumination having differing uses comprising:

a first source of light carried by the luminaire;

a first reflector disposed within the luminaire and carried thereby, at least a portion of the light generated by the first source of light exiting an aperture of the first reflector;

a second reflector carried by the luminaire and disposed about the first reflector, inner surfaces of the second reflector being spaced from outer surfaces of the first reflector about said first reflector thus forming an annulus therebetween at an aperture of the second reflector; and, a second source of light comprising light emitting diodes disposed within the luminaire for directing light through the annulus to provide a decorative effect at least by providing a dappled or scalloped appearance on surfaces of at least one of the reflectors.

31. The luminaire of claim 30 wherein the light emitting diodes provide a colored light.

* * * * *